US008011520B2

(12) United States Patent
Spiers et al.

(10) Patent No.: US 8,011,520 B2
(45) Date of Patent: Sep. 6, 2011

(54) STORAGE RACK

(76) Inventors: Dennis D. Spiers, Ogden, UT (US); Larry D. Williams, Ogden, UT (US)

( * ) Notice: Subject to any disclaimer, the term of this patent is extended or adjusted under 35 U.S.C. 154(b) by 0 days.

(21) Appl. No.: 12/126,830

(22) Filed: May 23, 2008

(65) Prior Publication Data

US 2009/0084743 A1 Apr. 2, 2009

Related U.S. Application Data

(62) Division of application No. 10/328,648, filed on Dec. 23, 2002, now Pat. No. 7,490,727.

(51) Int. Cl.
*A47F 5/08* (2006.01)

(52) U.S. Cl. ..... 211/89.01; 211/75

(58) Field of Classification Search ..... 211/89.1, 211/65, 66, 69.8, 69.9, 70.6, 94.01, 94.02, 211/75; 248/224.41, 62, 224.51, 63, 224.61, 248/298.1, 74.2, 74.3, 311.2, 225.11
See application file for complete search history.

(56) References Cited

U.S. PATENT DOCUMENTS

| | | | | | |
|---|---|---|---|---|---|
| 1,117,491 | A | * | 11/1914 | Hornung | 211/63 |
| 2,375,513 | A | * | 5/1945 | Bach | 248/59 |
| 2,615,577 | A | * | 10/1952 | Bartleman | 211/70.6 |
| 2,633,323 | A | * | 3/1953 | Burger | 248/312 |
| 2,868,489 | A | * | 1/1959 | Calcut | 248/229.26 |
| 3,154,281 | A | * | 10/1964 | Frank | 248/201 |
| 3,180,597 | A | * | 4/1965 | Havener | 248/68.1 |
| D207,411 | S | * | 4/1967 | Diesinger | D6/569 |
| 3,527,345 | A | * | 9/1970 | Iorio | 206/427 |
| 3,986,695 | A | * | 10/1976 | Hronas | 248/222.51 |
| 4,119,285 | A | * | 10/1978 | Bisping et al. | 248/72 |
| 4,379,536 | A | * | 4/1983 | Mizuno et al. | 248/73 |
| 4,542,871 | A | * | 9/1985 | Fortsch | 248/73 |
| 5,071,100 | A | * | 12/1991 | Sweeny | 248/313 |
| 5,570,794 | A | * | 11/1996 | Drower | 211/89.01 |
| D379,060 | S | * | 5/1997 | Laga | D8/373 |
| D379,427 | S | * | 5/1997 | Laga | D8/373 |
| 5,743,414 | A | * | 4/1998 | Baudino | 211/69.1 |
| 5,799,907 | A | * | 9/1998 | Andronica | 248/62 |
| 5,915,573 | A | * | 6/1999 | Drower et al. | 211/89.01 |
| 6,109,569 | A | * | 8/2000 | Sakaida | 248/75 |
| 6,220,557 | B1 | * | 4/2001 | Ziaylek et al. | 248/316.1 |
| 6,494,415 | B1 | * | 12/2002 | Roth | 248/74.1 |
| 7,490,727 | B2 | * | 2/2009 | Spiers et al. | 211/89.01 |
| 2004/0099624 | A1 | * | 5/2004 | Hein | 211/89.01 |
| 2004/0182802 | A1 | * | 9/2004 | Paul | 211/75 |

* cited by examiner

*Primary Examiner* — Jennifer E. Novosad
(74) *Attorney, Agent, or Firm* — Fehr Law Firm; Thompson E. Fehr

(57) ABSTRACT

A storage rack having one or more clamps and one or more rails. Each clamp has two or more resilient arms attached at a first end to opposite ends of a rear section, such resilient arms having free ends which permit the introduction of an object between the resilient arms. In one embodiment, each resilient arm contains at least one aperture through which a rail proceeds. For at least one aperture, the portion of the resilient arm which forms the outer edge of the forward wall of the aperture touches a first side of the rail while the portion of the resilient arm which forms the inner edge of the rear wall of the aperture touches a second side of the rail. In another embodiment, a deformable extension proceeds to the rear from the rear section of the clamp and contains at least one channel through which a rail proceeds.

3 Claims, 18 Drawing Sheets

STORAGE RACK

CROSS-REFERENCE TO RELATED APPLICATION

This application is a divisional application of prior application Ser. No. 10/328,648, filed on Dec. 23, 2002 now U.S. Pat. No. 7,490,727.

BACKGROUND OF THE INVENTION

1. Field of the Invention

This invention relates to a device for removably storing tubular and other elongated objects.

2. Description of the Related Art

U.S. Pat. No. 2,633,323 of Burger discloses a jar clip comprising a plurality of horseshoe-shaped metal clips which are fastened to the underside of a shelf or the like. The clips provide a space between the edge of the clip and the underside of the shelf or the like so that the lid of a jar may be slid laterally into an opening and retained by thereby having the edge of the clip being under the lip of the lid of the jar. A pair of resilient points may be provided in the edge near the entrance to the clip, in order to provide a springing or locking action around the neck of the jar when it is pressed into place.

U.S. Pat. No. 2,633,323 does show an embodiment having a plurality of openings for storing jars. These opening, however, do not functions as clamps and, thus, cannot hold objects, such as paint cans, caulking tubes, etc., that do not have a lip or groove to be supported by the edge of the clip. Moreover, the openings in the jar clip of Burger are not interchangeable or slidable and do not hold the jars from the sides.

U.S. Pat. No. 3,537,345 of Iorio covers a portable package for containers having a base portion in the form of a channel with depending legs and inwardly turned flanges which engage and support a lip or groove below the lid of a jar. As was the case with the Burger patent, there are, however, no interchangeable clamps for holding objects that do not have a lip or groove which can be supported.

U.S. Pat. No. 3,946,877 of Galicia applies to a clip-type holder for toothbrushes and the like. A base strip is adhesively mountable to a surface such as a wall and contains a plurality of integrally formed, flared, protruding clips. The clips have pairs of resilient arms that are deflected apart from one another when a suitable sized object, such as the handle of a toothbrush, is forced between such arms. The resilient arms thereby grip and frictionally retain such an object. The clips are, though, not either interchangeable or slidable.

U.S. Pat. No. 3,986,695 of Hronas concerns an elongate bar having a number of apertures into which a pair of hooks associated with a container cover are inserted and retained. Containers may be screwed onto the container covers. Although not explicitly stated in the Hronas patent, the elongated wall would presumably be fastened to a wall. This patent, though, does not include slidable, interchangeable clamps for holding an object.

U.S. Pat. No. 4,305,512 of Mackenzie discloses a jar organizer and storage rack that has a plurality of vertical tubes mounted to a rigid planar surface with a bar running along the bottom of the tubes. Jars or cans are stacked within the tubes and rest on the lower bar. Each tube contains a slot along its entire length, such slot having wider portions and narrower portions with the narrower portions capable of accommodating a human finger. A user may select a jar or can from within one of the tubes by locating such gar or can through the slot, grasping the jar or can with the user's fingers, and moving the jar or can to a wider portion of the slot for removal. There are, however, no slidable, interchangeable clamps.

U.S. Pat. No. 4,905,949 of Cosgrove concerns a device for releasably supporting a plurality of objects. The device has an elongated channel of PVC or similar plastic material, with depending sides and inwardly directed flanges. The flanges are configured for gripping the lip of a container such as the bottom or top of a can or the edge below the lid of a jar. The device of Cosgrove, though, does not possess clamps—let alone slidable, interchangeable clamps—and can only support those objects which have a lip.

U.S. Pat. No. 5,071,100 of Sweeny covers a wall-mounted bracket for holding canisters. Each bracket consists of a rear wall having a flexible strap and a support lip at the bottom. The flexible strap has notches for closing the strap at various lengths so that such strap can firmly hold a variety of sizes of canisters against the rear wall. Several brackets can be rigidly connected to one another with a web. There are again, however, no slidable, interchangeable clamps.

U.S. Pat. No. 5,655,673 of Weterrings et al. has a plurality of pairs of resilient arms extending from a back panel that can be attached to a surface such as a wall. The pairs form semi-cylindrical holders but also have inward projections to support an object, such as a spice jar. The pairs, though, are neither slidable nor interchangeable.

U.S. Pat. No. 5,964,359 of Marino discloses a device that is somewhat similar to that of U.S. Pat. No. 2,633,323 of Burger. A plurality of horseshoe-shaped slots are disposed on the underside of a shelf or the like. The slots each have downwardly depending sides and inwardly oriented flanges, which support the edges of unique rectangular lids or covers for containers. The slots form a space between the flanges and the underside of the shelf or the like wherein the rectangular lids may be slid. The lid may be attached to a jar so that the flanges may thereby support the jar. Once more, there are no slidable or interchangeable clamps.

U.S. Pat. No. 6,109,569 of Sakaida does, though, in the embodiment of FIGS. 7 and 8 have interchangeable clamps that are slidably mounted within a support rail that is, according to lines 51 through 59 of column 4, "fixedly mounted on . . . instruments, wall surfaces, floor and the like . . . "

U.S. Pat. No. Des. 207,411 of Diesinger appears to show a spice rack that is similar to the devices in U.S. Pat. No. 2,633,323 of Burger and U.S. Pat. No. 5,964,359 of Marino.

U.S. Pat. Nos. Des. 379,060 and 379,427 of Laga show clips on a bar. The design patents do not clarify whether the clips or slidable or interchangeable. The clips for the device of Pat. No. Des. 379,060, though appear to be fastened to the bar with rivets, impairing any slidability or interchangeability. Moreover, the construction of both devices—especially the stud mounting brackets at the ends of each bar—would seem to preclude the interchange of clamps.

And U.S. Pat. No. Des. 413,035 of Weterrings et al. appears to be identical to U.S. Pat. No. 5,655,673 of Weterrings et al.

None of the preceding patents, however, have a clamp with resilient arms the deflection of which produces a braking effect that prevents the clamp from sliding.

BRIEF SUMMARY OF THE INVENTION

The present invention has one or more clamps with resilient arms for grasping an object. These clamps are slidably mounted on one or more, preferably two, rails. The deflection of the arms produces sufficient resistance that the clamp remains stationary while holding an object.

In order to preclude sliding when no object is being held and with the rail or rails running vertically, each clamp preferably produces resistance to movement even when the resilient arms are not deflected. The level of this resistance is preferably, though, at a level which can be overcome by a user to slide a clamp to another location on the rail or rails, and pushing the resilient arms toward one another will reduce such resistance.

The resistance is created by having one or more channels which tend to be increasingly deformed as the arms of the clamps are deflected more. In a first embodiment, the channel or channels are comprised of apertures in the clamps, themselves. In a second embodiment, the channel or channels are in a deformable extension of the clamp which projects rearwardly from the clamp.

DETAILED DESCRIPTION OF THE INVENTION

Figure 1:
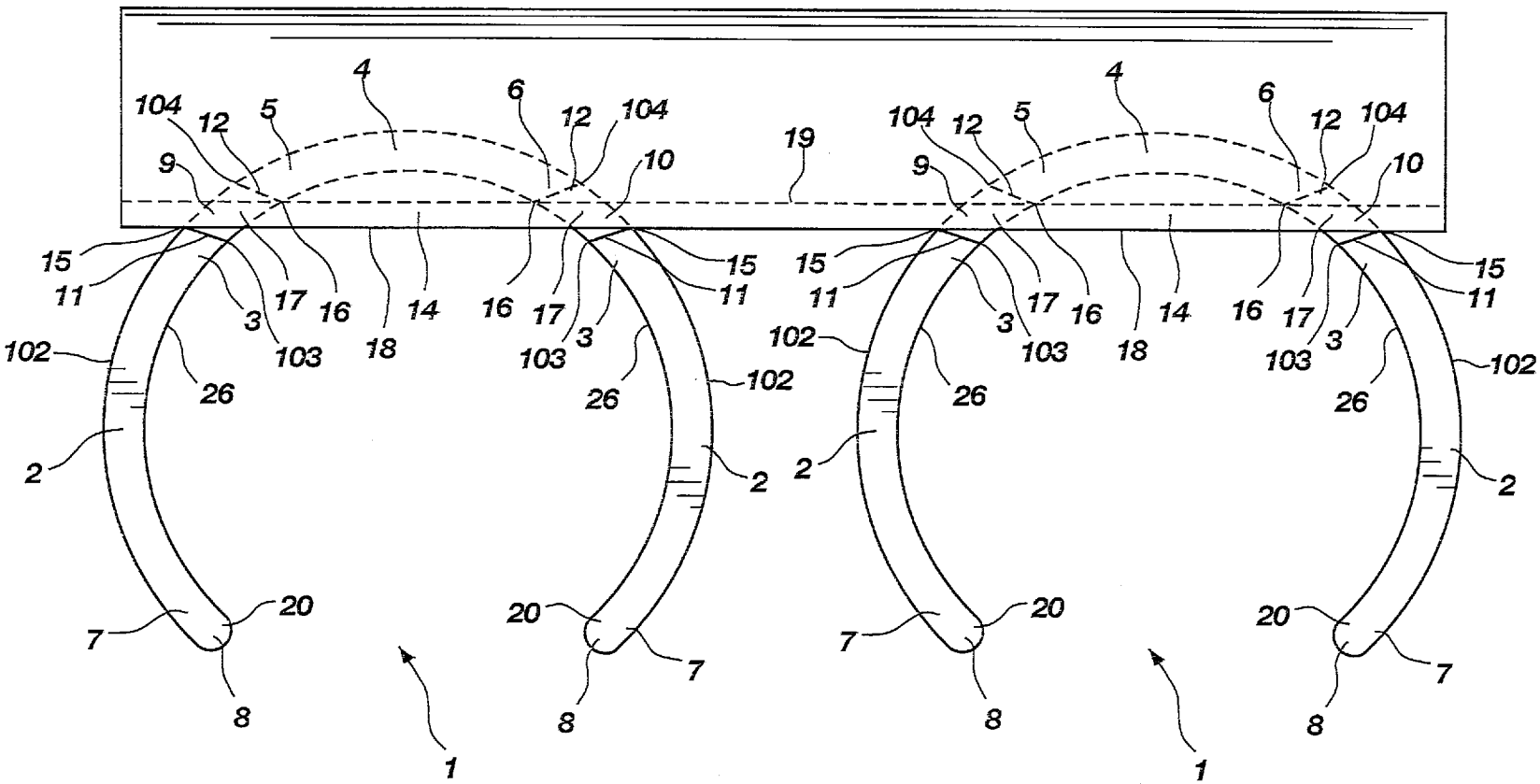
FIG. 1 is a plan view, from above, of a first preferred embodiment for the clamp showing the relationship between a rail and a first preferred embodiment for the clamp.
Figure 2:
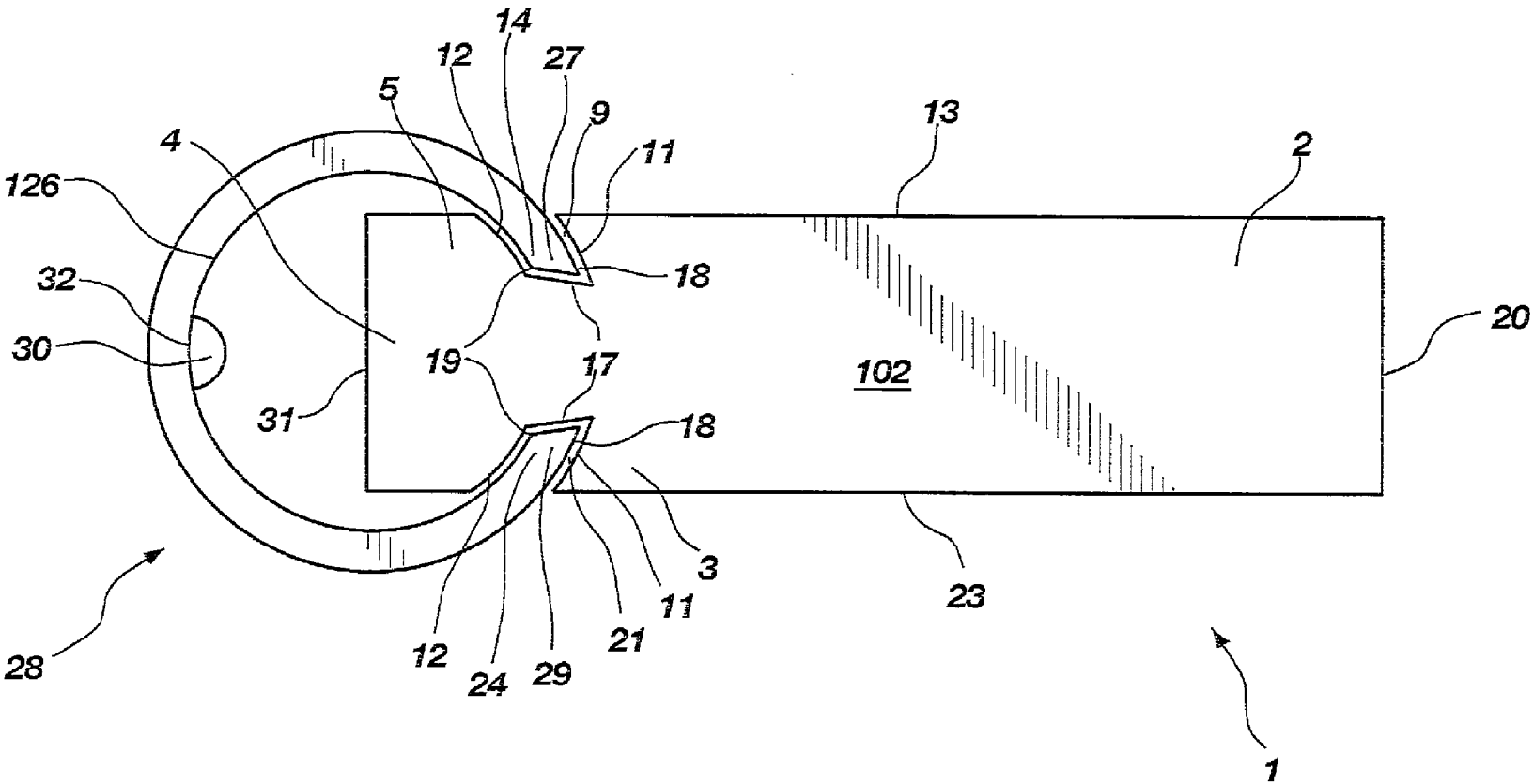
FIG. 2 presents a lateral view of a first preferred embodiment for the clamp.

In a first preferred embodiment, the Storage Rack of the present invention has a clamp 1 comprising two or more resilient arms 2, each arm 2 having a first end 3 with such first end 3 attached to a rear section 4. A preferred embodiment of the clamp 1 is shown in FIGS. 1 and 2.

As the resilient arms 2 proceed forward from the rear section 4, the resilient arms 2 on a first end 5 and a second end 6 of the rear section 4, which ends 5, 6 of the rear section 4 are substantially opposite one another, initially also move away from each other before bending back towards one another. In other words, initially as the distance along the resilient arms 2 from the rear section 4 is increased, the distance between the rear arms 2 is greater. Then, at given greater distances along the resilient arms 2 from the rear section 4, the distance between the rear arms 2 is progressively less.

The Storage Rack is designed to hold any object that will fit within the clamp 1 and also objects which have a cross section with a greatest dimension at a point intermediate between a forward end and a rear end, especially, but not exclusively, tubular objects such as cans. (Object can refer to an entire unit or only a portion thereof, such as a handle.)

The forward portion 7 of each resilient arm 2 is shaped to permit the introduction of a can or other container or elongated object between the resilient arms 2. Preferably, but not necessarily, this is accomplished simply by having free ends 8 on the forward portions 7 of the resilient arms 2 on opposite ends 5, 6 of the rear section 4 a sufficient distance apart that an object can have an initial portion of the object placed between the resilient arms 2 on opposite ends 5, 6 of the rear section 4 and then be pushed toward the rear section 4 and thereby force the resilient arms 2 on opposite ends 5, 6 of the rear section 4 sufficiently far from one another to permit complete introduction of an object that can fit completely between the resilient arms 2 on opposite ends 5, 6 of the rear section 4 or complete introduction of the portion of the object having the maximum intermediate dimension. As soon as the entire object or the portion of the object having the maximum cross-sectional dimension has gone past the forward portions 7 of the resilient arms 2 on opposite ends 5, 6 of the rear section 4, the resilient arms 2 on opposite ends 5, 6 of the rear section 4 will begin moving toward one another again. When the object or the portion of the object having the maximum cross-sectional dimension is entirely within the resilient arms 2 on opposite ends 5, 6 of the rear section 4, the resilient arms 2 on opposite ends 5, 6 of the rear section 4 will frictionally retain the object since they are urged toward one another. (Of course, when a user has an object that the user desires the clamp 1 to retain, the user selects a clamp 1 with such dimensions that the resilient arms 2 will be forced from one another when the object or the portion of the object having the maximum cross-sectional dimension is entirely within the resilient arms 2.)

Figure 3:
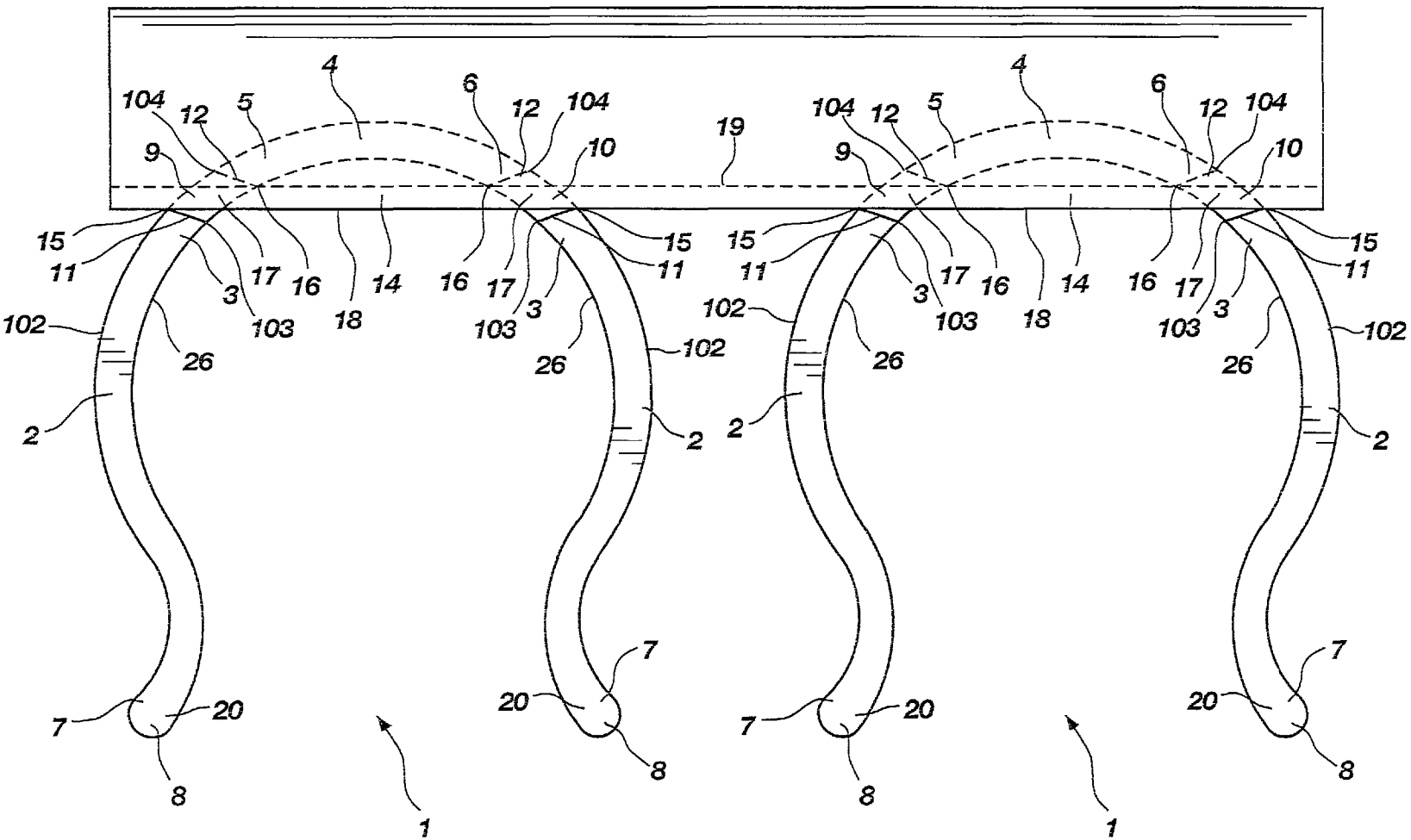
FIG. 3 illustrates, in a plan view from above, a variation of the first preferred embodiment for the clamp.
Figure 4:
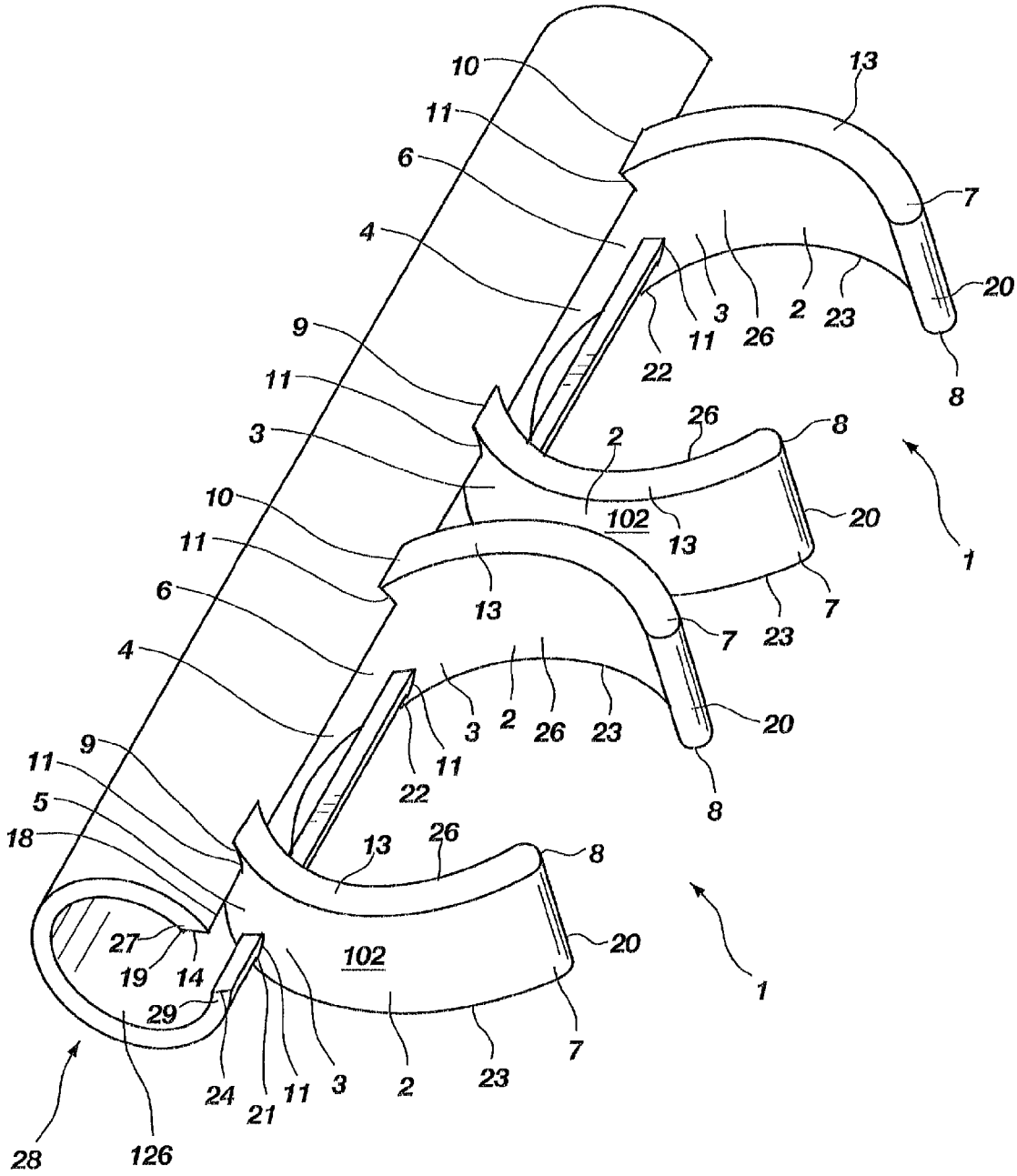
FIG. 4 is an isometric view of a first preferred embodiment for rails.

Alternatively, as illustrated in FIG. 3, the resilient arms 2 on opposite ends 5, 6 of the rear section 4 can, after bending back toward one another, approach or even actually touch each other and then again extend away from one another. In other words, after having the distance between the resilient arms 2 decrease with increasing distance from the rear section 4, as the distance along the resilient arms 2 from the rear section 4 is further increased, the distance between the resilient arms is progressively decreased.

With any embodiment of the clamp 1 it is preferable to have the free ends 8 of the resilient arms 2 rounded in order to preclude scratching an object to be retained or a label on such object.

Each clamp 1 contains, as a channel, a first aperture 9 and a second aperture 10, each of the first and second apertures 9, 10 having a forward wall 11 and a rear wall 12. Preferably, but not necessarily, the first aperture 9 and the second aperture 10 touch, near the point of maximum width for each of the first and second apertures 9, 10 the top 13 of the resilient arm 2 so that a first rail 14 can extend into the first and second apertures 9, 10; otherwise, the first rail 14 would run through the first and second apertures 9, 10 with such first and second apertures 9, 10 being completely within the clamp 1.

The forward wall 11 extends from an inner lateral surface 26 of the resilient arm 2 within which the first aperture 9 is located (Such inner lateral surface 26 being the surface between the top 13 and the bottom 23 of the resilient arm 2 within which the first aperture 9 is located that is closer to the resilient arm 2 within which the second aperture 9 is located.) to an outer lateral surface 102 of the resilient arm 2 within which the first aperture 9 is located (Such outer lateral surface 102 being the surface between the top 13 and the bottom 23 of the resilient arm 2 within which the first aperture 9 is located that is farther from the resilient arm 2 within which the second aperture 10 is located.).

Similarly, the rear wall 12 extends from an inner lateral surface 26 of the resilient arm 2 within which the first aperture 9 is located (Such inner lateral surface 26 being the surface between the top 13 and the bottom 23 of the resilient arm 2 within which the first aperture 9 is located that is closer to the resilient arm 2 within which the second aperture 9 is located.) to an outer lateral surface 102 of the resilient arm 2 within which the first aperture 9 is located (Such outer lateral surface 26 being the surface between the top 13 and the bottom 23 of the resilient arm 2 within which the first aperture 9 is located that is farther from the resilient arm 2 within which the second aperture 10 is located.).

For the second aperture 10 the forward wall 11 and the rear wall 12 are constructed in the same manner as described in the immediately preceding two paragraphs.

The first and second apertures 9, 10 are, furthermore, located at the junction of a resilient arm 2 and the rear section 4, since, for the purposes of this invention, the rear section 4 is defined as the portion of the clamp 1 between the first aperture 9 and the second aperture 10. Consequently, the rear wall 12 is formed by the rear section 4; and the forward wall 11 is formed by the resilient arm 2.

The intersection of the forward wall 11 with the outer lateral surface 102 is termed the outer edge 15 of the forward wall 11; the intersection of the forward wall 11 with the inner lateral surface 26 is termed the inner edge 103 of the forward wall 11; the intersection of the rear wall 12 with the outer lateral surface 102 is termed the outer edge 104 of the rear wall 12; and the intersection of the rear wall 12 with the inner lateral surface 26 is termed the inner edge 16 of the rear wall 12.

As illustrated in FIG. 1, for at least one aperture 9 or 10, the forward wall 11 and the rear wall 12 are preferably formed so that the outer edge 15 of the forward wall 11 touches the first rail 14, and the inner edge 16 of the rear wall 12 touches the first rail 14 with the width 17 of the aperture 9 or 10 being selected so that the frictional force created by the outer edge 15 of the forward wall 11 touching a first side 18 of the first rail 14 while the inner edge 16 of the rear wall 12 touches a second side 19 of the first rail 14 will prevent an empty clamp 1 from sliding along the first rail 14, no matter what the orientation of the first rail 14 may be. (The level of this frictional resistance is, though, as stated above, preferably selected at a level which can be overcome by a user to slide a clamp 1 to another location on the first rail 14. Such resistance can, however, be reduced by pushing the resilient arms 2 toward one another.) The first side 18 and the second side 19 of the first rail 14 are located with respect to each other so that the force created by the outer edge 15 of the forward wall 11 on the first rail 14 has at least a component that is opposite to at least a component of the force created by the inner edge 16 of the rear wall 12 on the first rail 14. The first side 18 and the second side 19 are substantially parallel to one another. (If the first rail 14 has a cross section that is shaped other than as a rectangle, "side" refers only to the portion of the first rail 14 against which the necessary force is applied. And if the shape of the apertures 9, 10 is other than rectangular, "forward wall" refers to the portion of the clamp 1 which generates a force having a component acting generally away from the free ends 8 of the resilient arms 2 while "rear wall" refers to the portion of the clamp 1 which generates a force having a component acting generally toward the free ends 8 of the resilient arms 2.)

Also preferably, but not necessarily, the forward wall 11 and the rear wall 12 of aperture 10 are substantially similarly formed; and the width 17 of aperture 10 is similarly selected.

When a resilient arm 2 attached to an end 5 of the rear section 4 and associated with a first or second aperture 9 or 10 having the forward wall 11 and the rear wall 12 so formed and the width 17 so selected, is forced away from a resilient arm 2 attached to the opposite end 6 of the rear section 4, for example, by an object being inserted between such resilient arms 2, the force exerted by the outer edge 15 of the forward wall 11 on the first side 18 of the first rail 14 will increase, the rear section 4 will be drawn toward the resilient arm 2, and the force exerted by the inner edge 16 of the rear wall 12 on the second side 19 of the first rail 14 will increase. The frictional force exerted on the first rail 14 will then be adequate to retain the clamp 1 holding the object in place no matter what the orientation of the first rail 14 may be. Moreover, when a clamp 1 is horizontally oriented, the weight of the object acting on the resilient arm 2 will tend to increase the force exerted by the lower, outer edge 15 of the forward wall 11 the farther such force is applied toward the front 20 of the clamp 1 and will also tend to increase the force exerted by the upper, inner edge 16 of the rear wall 12 the farther such force is applied toward the front 20 of the clamp 1.

Additionally, preferably, but not necessarily, the first and second apertures 9, 10 have a substantially rectangular cross section. This is also true for the first rail 14, although, as suggested above, the apertures 9, 10 and the cross section of the first rail 14 can be of any shape and the shape of the apertures 9, 10 may even differ from the shape of the cross section of the first rail 14 as long as forces between at least one of the apertures 9, 10 and the first rail 14 are as described above.

And even more preferably, but not necessarily, the clamp 1 contains, as a second channel, a third aperture 21 and a fourth aperture 22 which preferably touch, preferably near the point of maximum width for each aperture 21, 22 the bottom 23 of the resilient arm 2 in which the respective aperture 21, 22 is located while the first aperture 9 and the second aperture 10 preferably touch, preferably near the point of maximum width for each aperture 9, 10 the top 13 of the resilient arm 2 in which the respective aperture 9, 10 is located. Also preferably, the shape dimension, orientation, and location for the third aperture 21 along the bottom 23 of the resilient arm 2 is substantially the same as that for the first aperture 9 along the top 13 of the resilient arm 2; and the shape dimension, orientation, and location for the fourth aperture 22 along the bottom 23 of the resilient arm 2 is substantially the same as that for the second aperture 10 along the top 13 of the resilient arm 2. A second rail 24 runs through the third and fourth apertures 21, 22, is substantially parallel to the first rail 14, and is constructed substantially the same as the first rail 14. Consequently, this embodiment has the ability to have the clamp 1 inserted into the rails 14, 24 with either set of aperture 9, 10 or 21, 22 associated with either rail 14 or 24.

Although the resilient arms 2 need only have the bent shape discussed above and although the rear section 4 can have any shape, the resilient arms 2 and the rear section 4 preferably constitute arcs of a circle. Furthermore, even though the resilient arms 2 are preferably symmetrical about the rear section 4, symmetry is not necessary.

Figure 5:
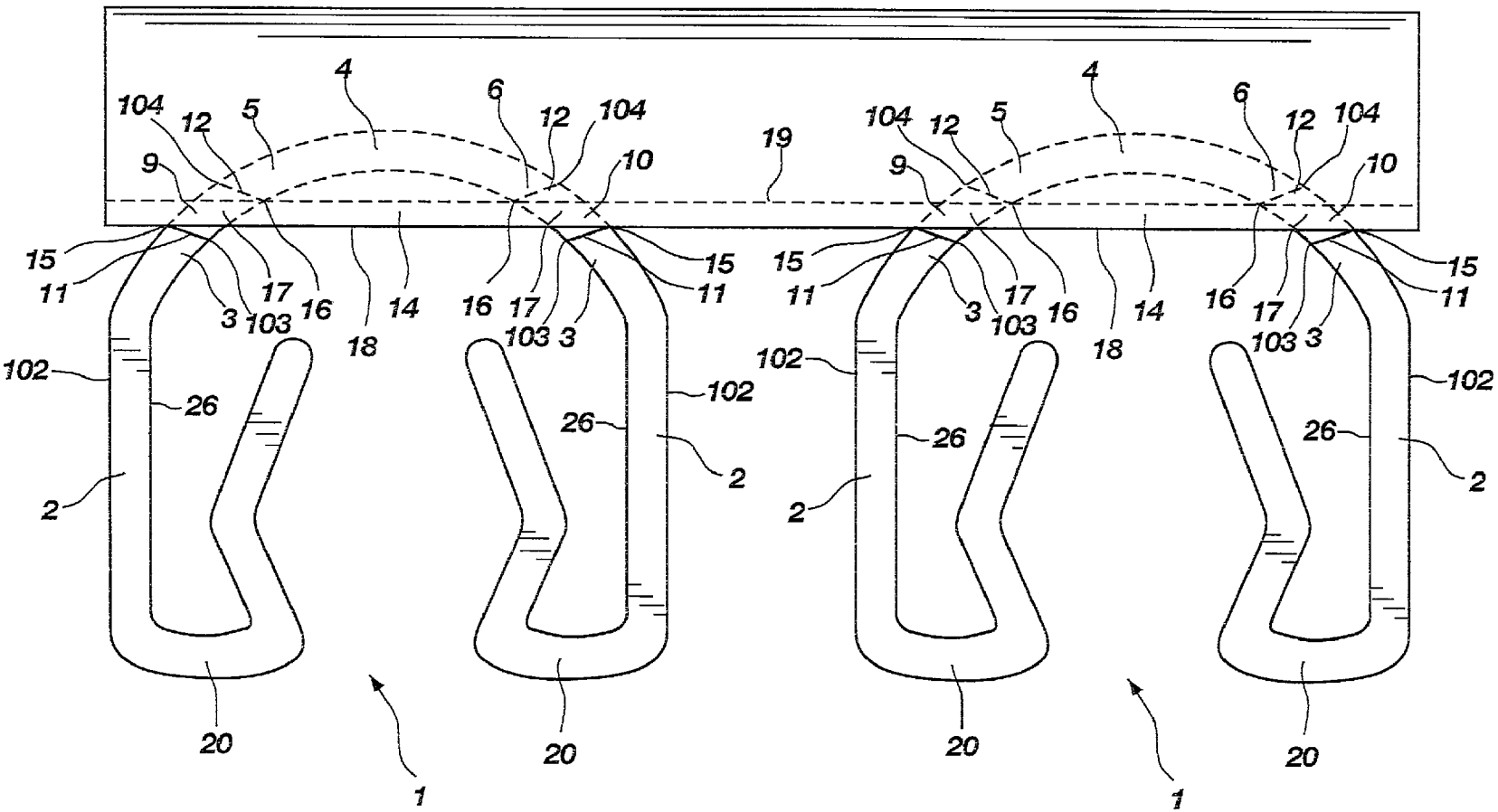
FIG. 5 depicts a clamp having the traditional shape for holding the handle of a broom.

Other exemplary shapes for the resilient arms 2 are the traditional shape of a clamp for holding the handle of a broom as depicted in FIG. 5, portions of any polygon having the requisite bent shape as discussed above, and the shape portrayed in FIG. 11 wherein the resilient arms 2 are formed similar to the number "6" and a mirror image of the number "6" except that the free end 8 does not actually touch the portion of the resilient arm 2 between the first end 3 and the forward portion 7 of the resilient arm 2.

Figure 11:
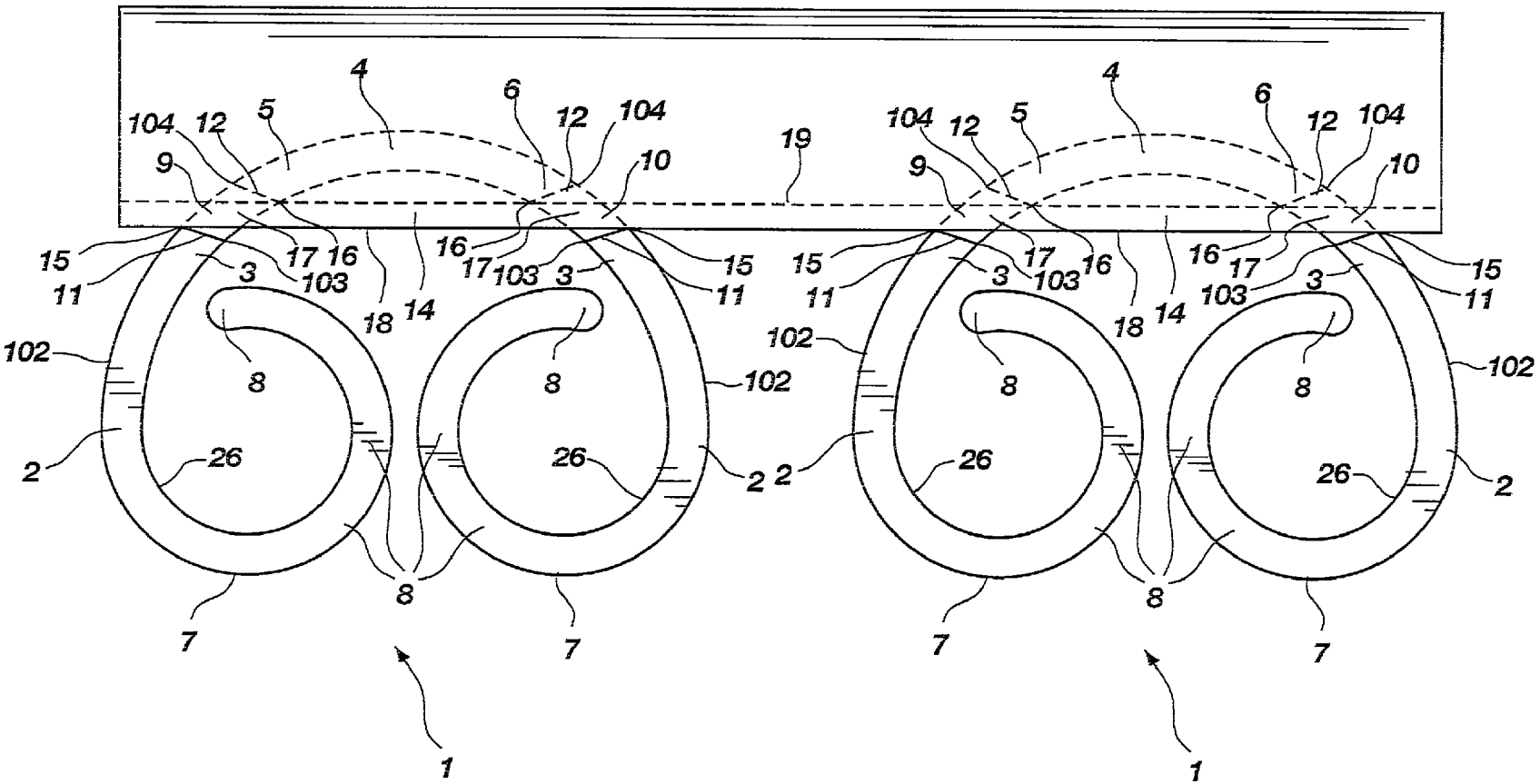
FIG. 11 is a plan view, from above, of a clamp for holding one or more wires.
Figure 12:
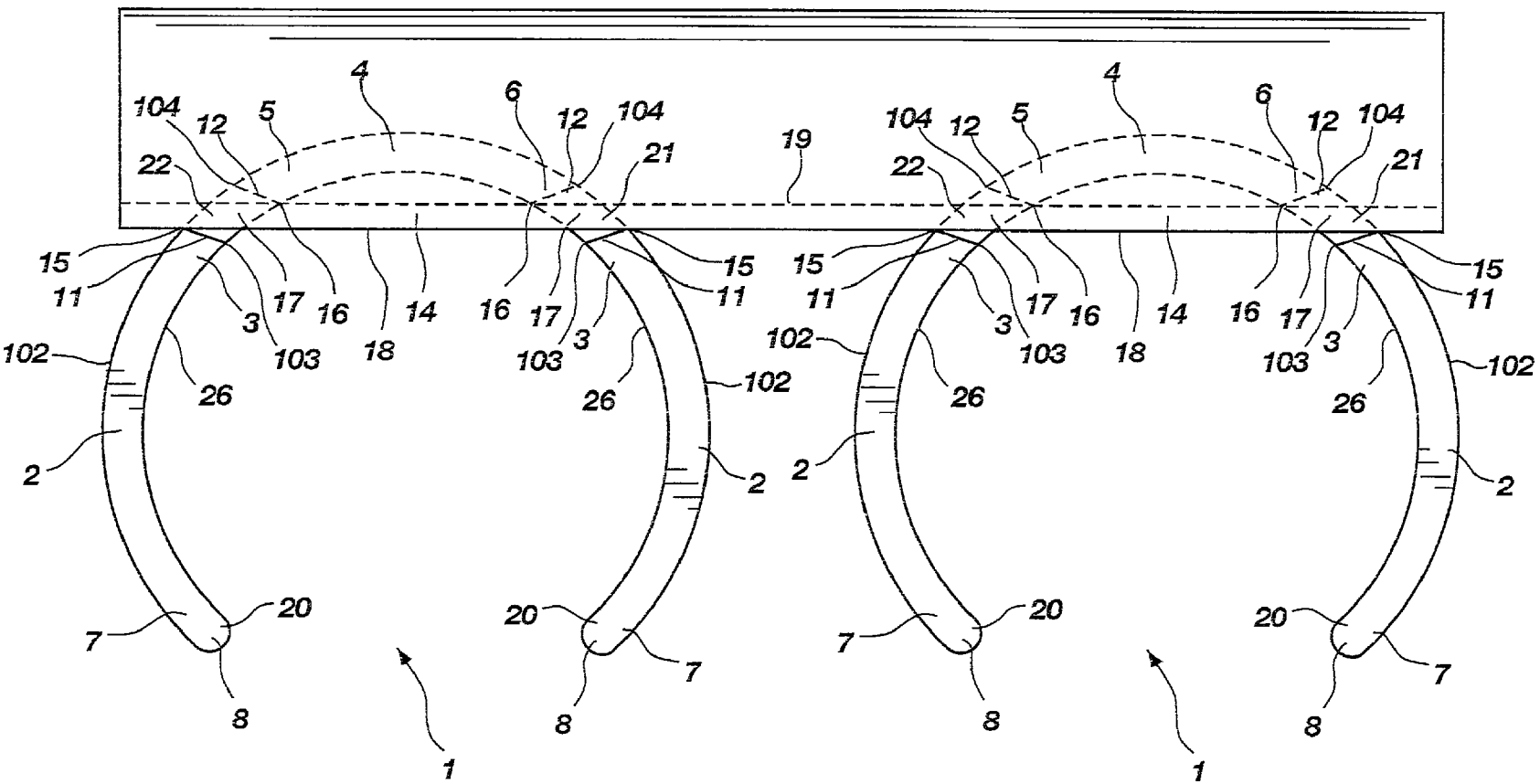
FIG. 12 is a plan view, from below, of the embodiment of FIG. 1.
Figure 13:
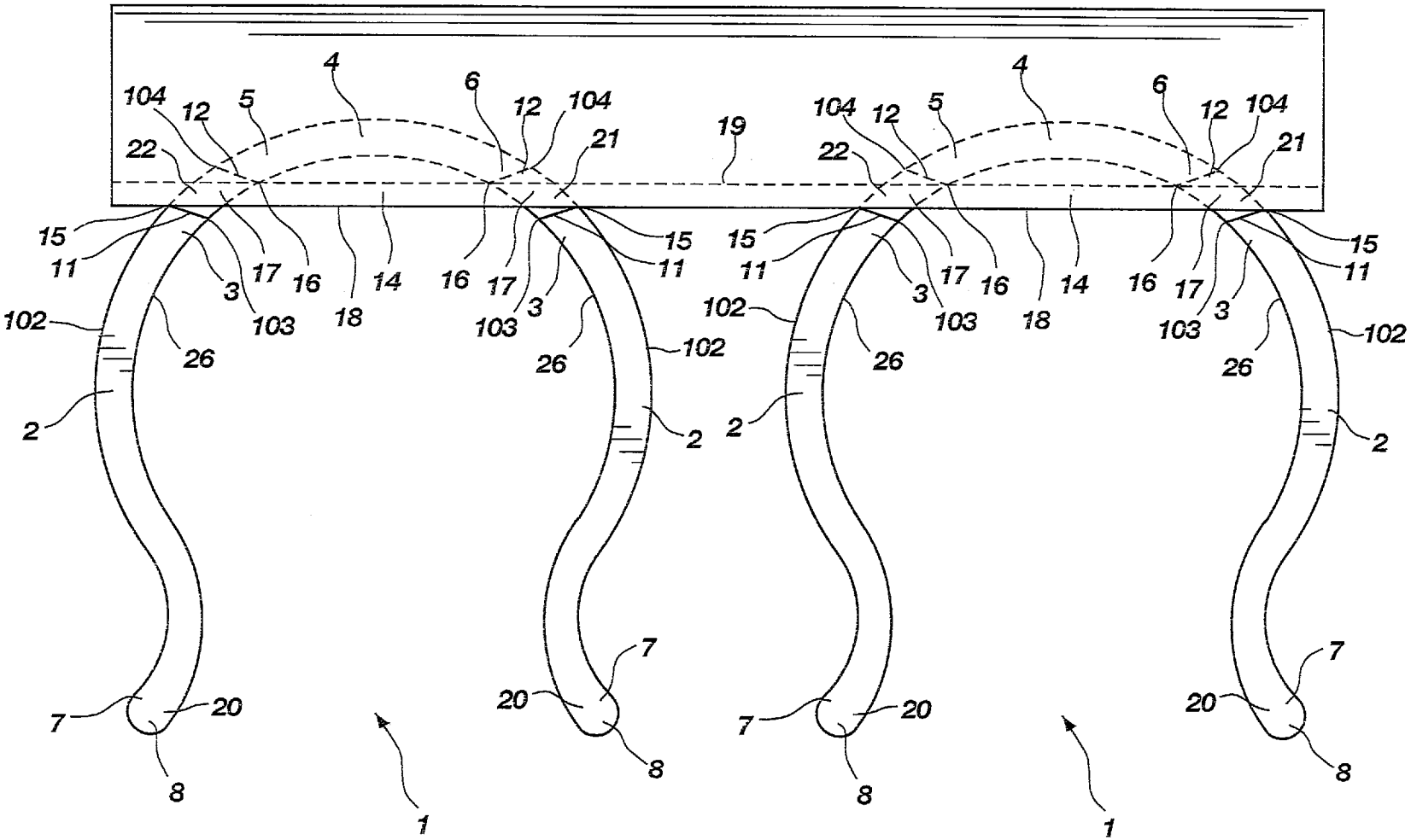
FIG. 13 is a plan view, from below, of the embodiment of FIG. 3.
Figure 14:
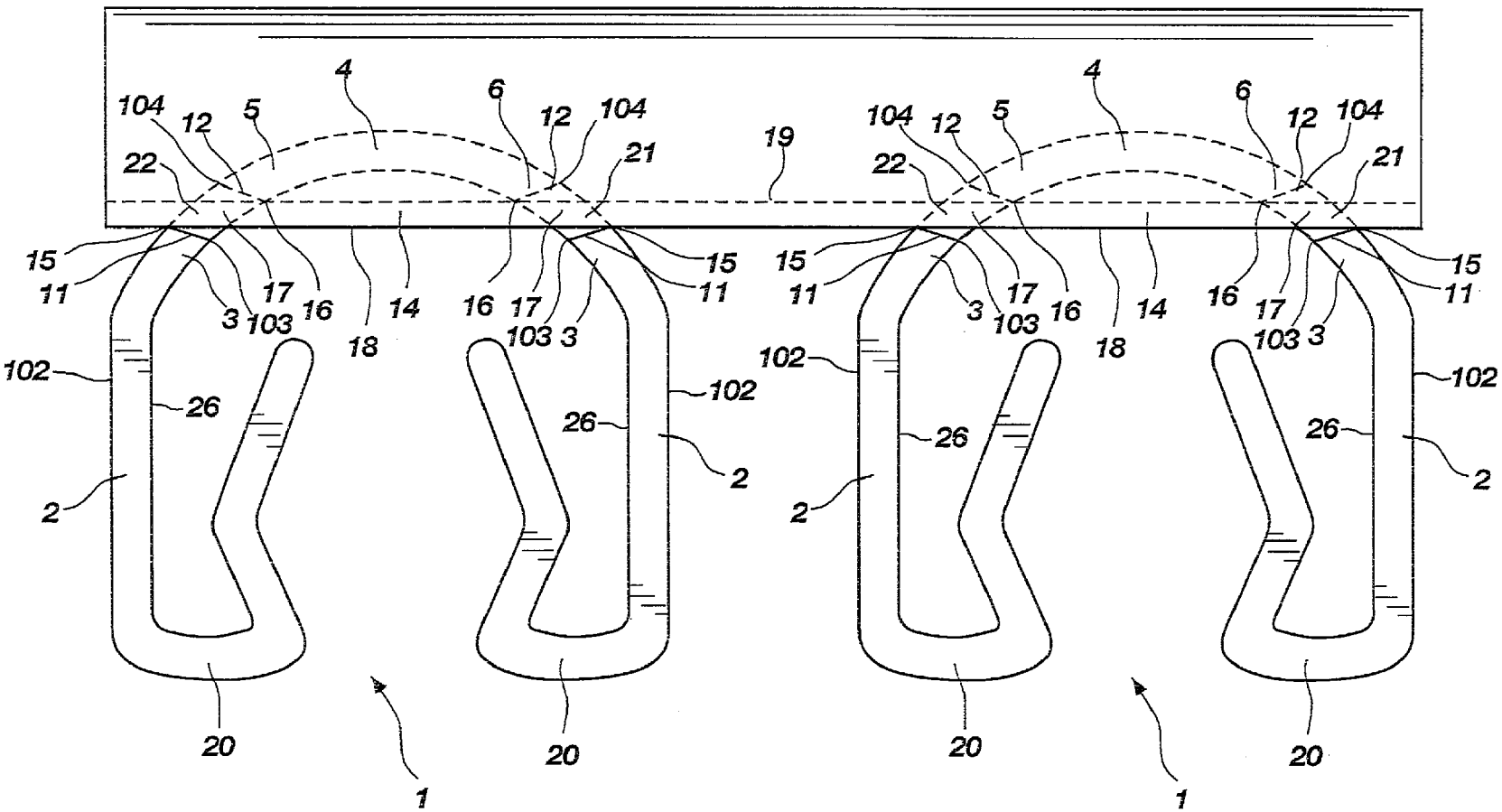
FIG. 14 is a plan view, from below, of the embodiment of FIG. 5.
Figure 15:
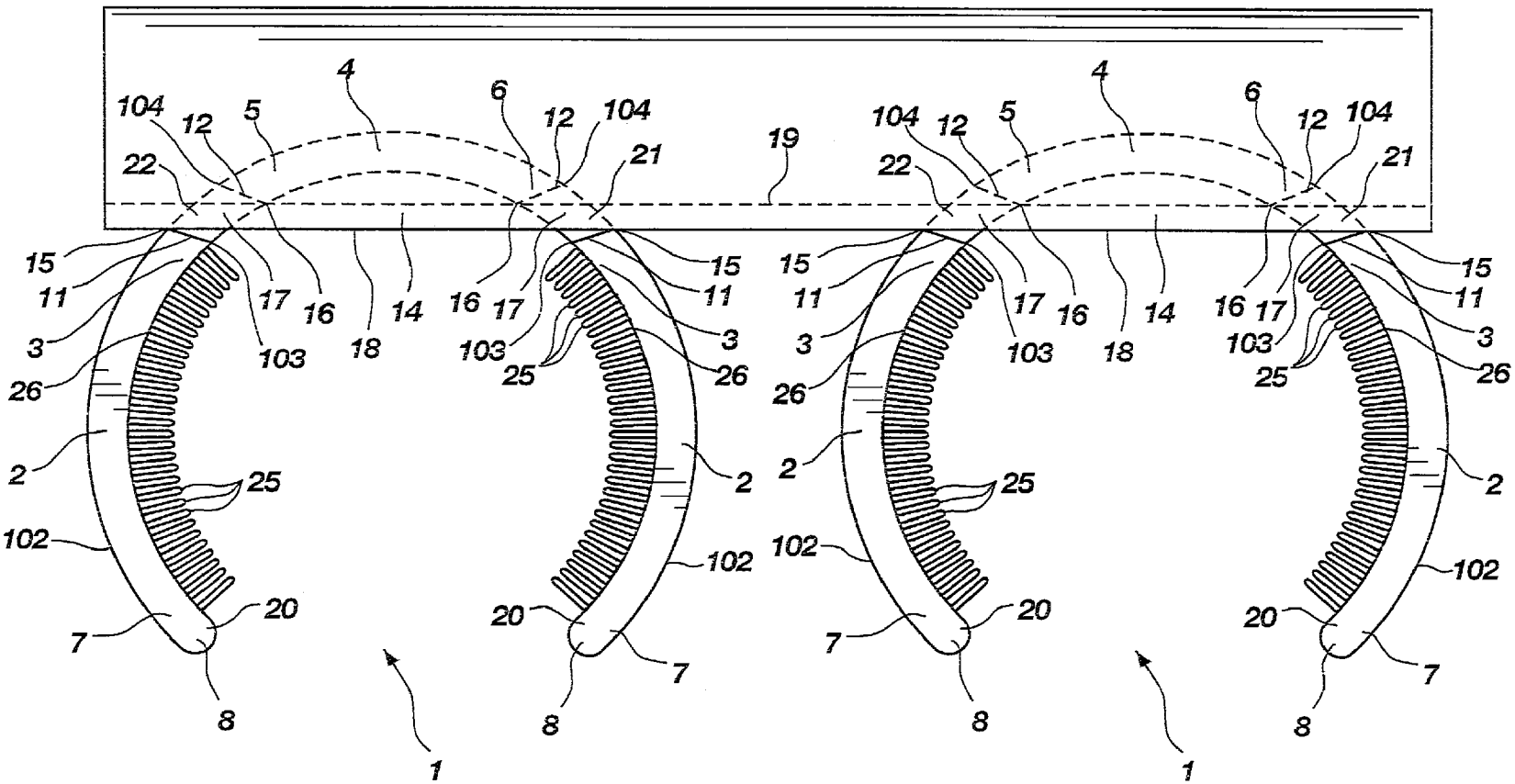
FIG. 15 is a plan view, from below, of the embodiment of FIG. 6.
Figure 16:
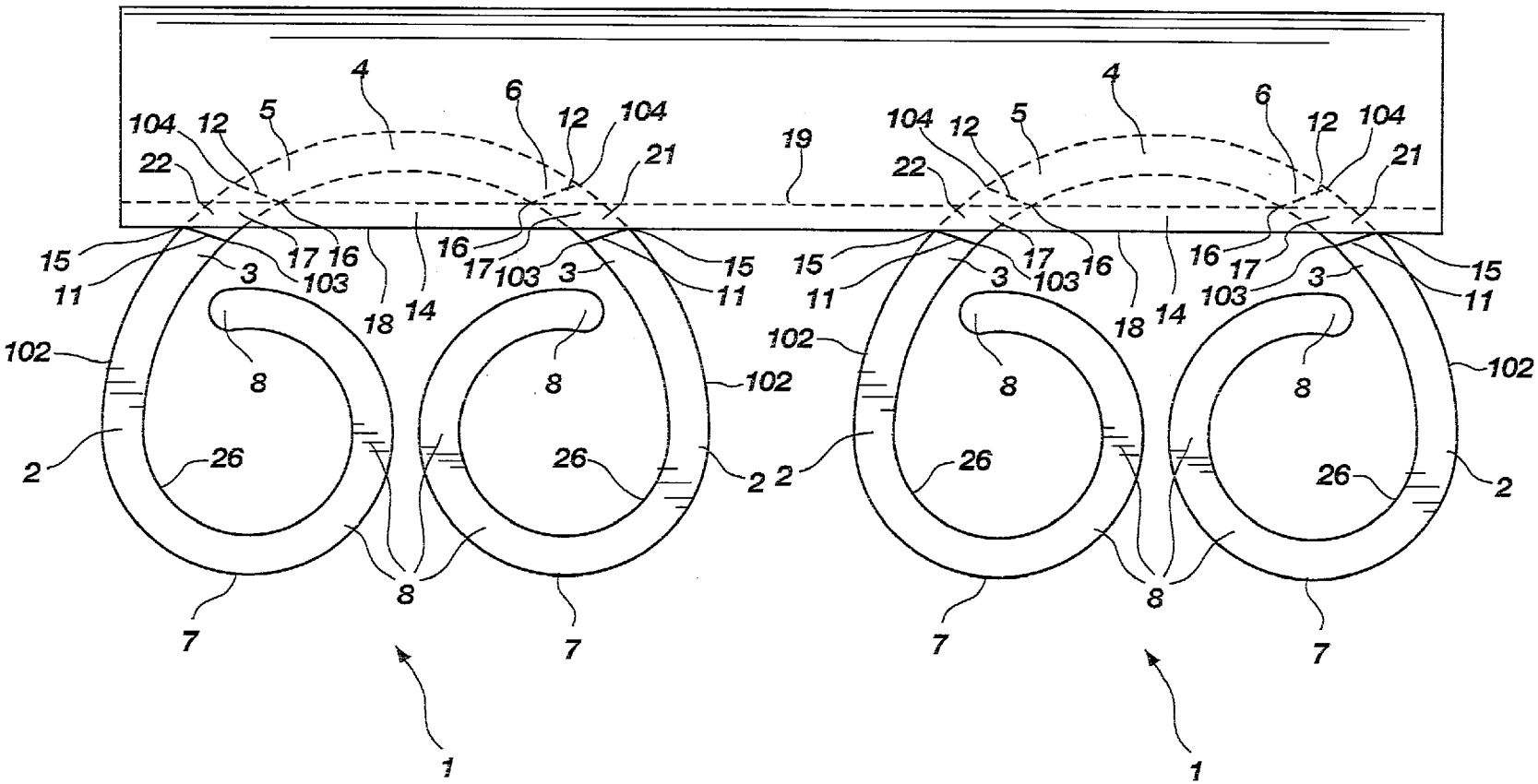
FIG. 16 is a plan view, from above, of the embodiment of FIG. 11.
Figure 17:
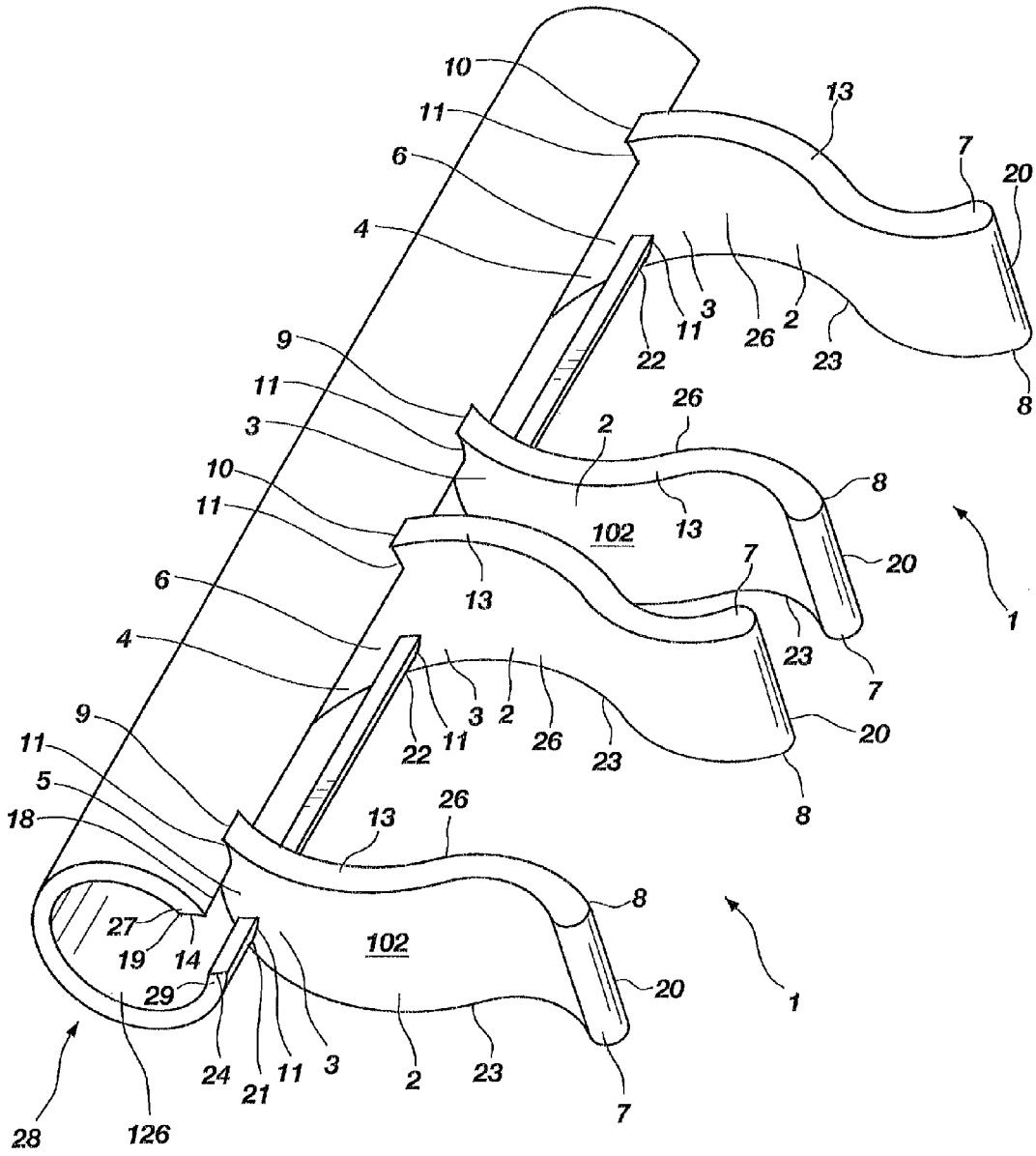
FIG. 17 is a perspective view of a first preferred embodiment for rails employing the variation of the embodiment of the clamp illustrates in FIG. 3.
Figure 18:
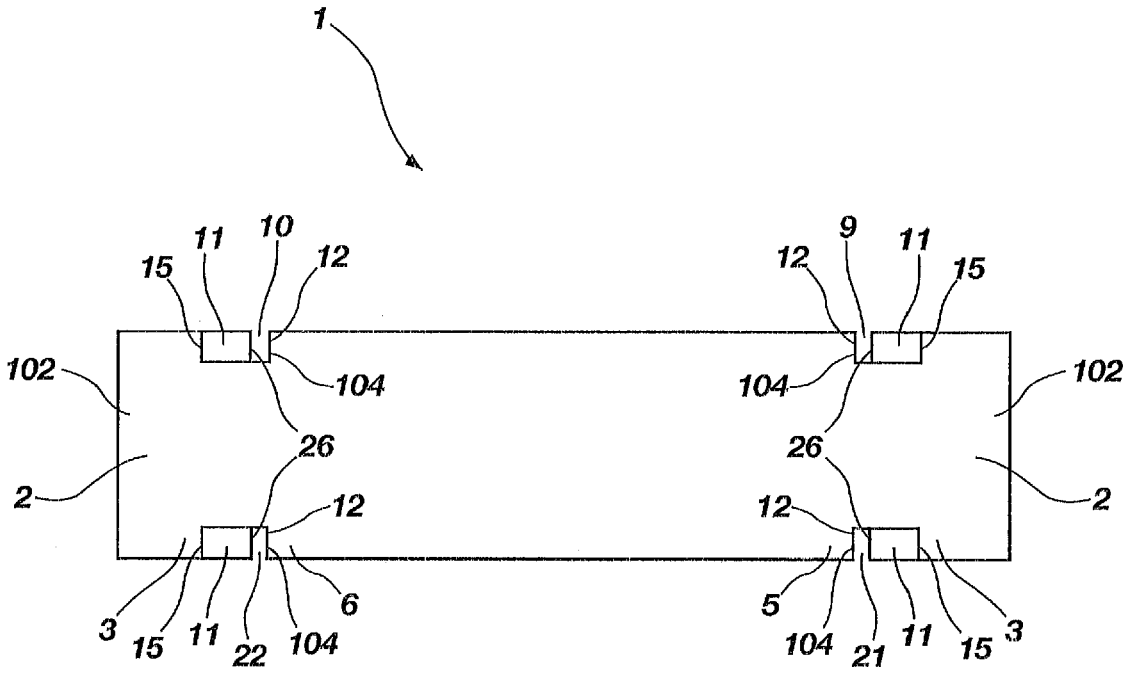
FIG. 18 is an elevational view of the rear of the embodiment of the clamp of either FIG. 1 or FIG. 3 since, in such a view, both of these embodiments look the same.

The embodiment of the clamp 1 shown in FIG. 11 differs from the other embodiments of the clamp 1 in that it is not necessarily intended that the object held by this embodiment force the resilient arms 2 farther from each other. The embodiment of the clamp 1 shown in FIG. 11 is intended to hold one or more wires. Only for the purposes of the embodiment of the clamp 1 shown in FIG. 11, the free end 8 shall mean the portion of each resilient arm 2 that lies farther along the resilient arm 2 from the first end 3 of the resilient arm 2 than does the forward portion 7 of the resilient arm 2. And, again only for the purposes of the embodiment of the clamp 1 shown in FIG. 11, "held between the resilient arms" 2 shall simply mean that a portion of the object intended to be retained by the clamp 1 is present between the free end 8 of a resilient arm 2 and the remainder of that resilient arm 2 and can only be removed from the clamp 1 by being passed between the free ends 8 of the resilient arms 2 of that clamp unless the object is moved perpendicularly to the plane of the clamp 1.

Figure 6:
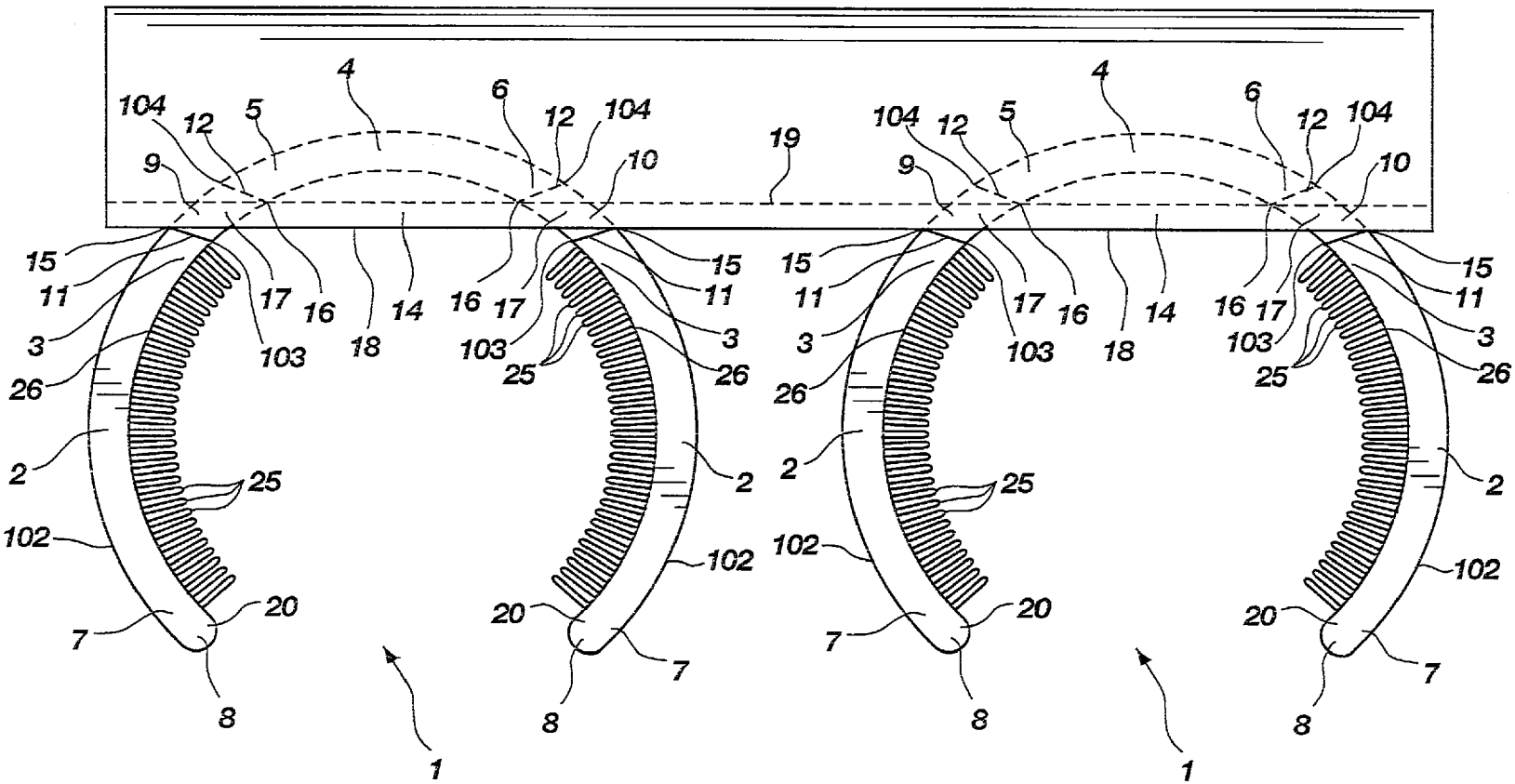
FIG. 6 shows a clamp having semi-rigid projections on the interior surface of each resilient arm.

If desired, as illustrated in FIG. 6, semi-rigid projections 25 can be attached to the interior surface 26 of each resilient arm 2 in order to retain an object while minimizing the risk of any damage to a label that may be on the object.

The first rail 14 is preferably, but not necessarily, a first radial end 27 of a C-shaped channel 28; and the second rail 24 is preferably, but not necessarily, a second radial end 29 of the C-shaped channel 28.

The C-shaped channel 28 can be attached to a surface by any means that is well known in the art. This would include, but not be limited to, screws.

When the C-shaped channel 28 is utilized, adequate distance must be maintained for the rear section 4 to pass any fastener 30. Preferably, but not necessarily, the rear section 4 and the resilient arms 2 attached to the rear section 4 constitute an arc of a circle and have a uniform thickness. The diameter of the circle and the locations for the apertures 9, 10, 21, and 22 are preferably, but not necessarily, selected such that the back 31 of the rear section 4 is half the cross-sectional width of the C-shaped channel 28 away from the vertical center 32 of the interior surface 126 of the C-shaped channel 28 toward the radial ends 28, 29. (Of course, if a fastener 30—such as a strap tie—that does not intrude into the C-shaped channel 28 is utilized, such clearance is not a concern.)

Also, as illustrated in FIG. 2, when the C-shaped channel 28 is employed, the rear wall 12 of the first and second apertures 9, 10 preferably, but not necessarily, curves to the rear as it rises in order to accommodate the shape of the C-shaped channel 28; and the rear wall 12 of the third and fourth apertures 21, 22 curves to the rear as it descends in order to accommodate the shape of the C-shaped channel 28. Although such curving preferably follows the shape of the C-shaped channel 28, for the purpose of this patent application curve simply means so moving to the rear as the rear wall 12 rises (in the cases of the first and second apertures 9, 10) or descends (in the cases of the third and fourth apertures 21, 22) that the rear wall 12 does not physically conflict with the C-shaped channel 28 except as desired to create the frictional force described above. Thus, "curve" comprises even an upwardly or downwardly sloped straight line.

Although, for purposes of illustration, only one or two clamps 1 have been shown in association with a first rail 14 or rails 14, 24, as few or as many clamps 1 as the relative dimensions of the clamps 1 and first rail 14 or rails 14, 24 will permit may be placed on the first rail 14 or rails 14, 24. Furthermore, the shapes and sizes of the resilient arms 2 of different clamps 1 need not be identical to one another.

And, of course, if desired, an individual clamp 1 could be fastened to a surface such as a wall by any means that is well known in the art, rather than being used with a first rail 14 or rails 14, 24.

Figure 7:
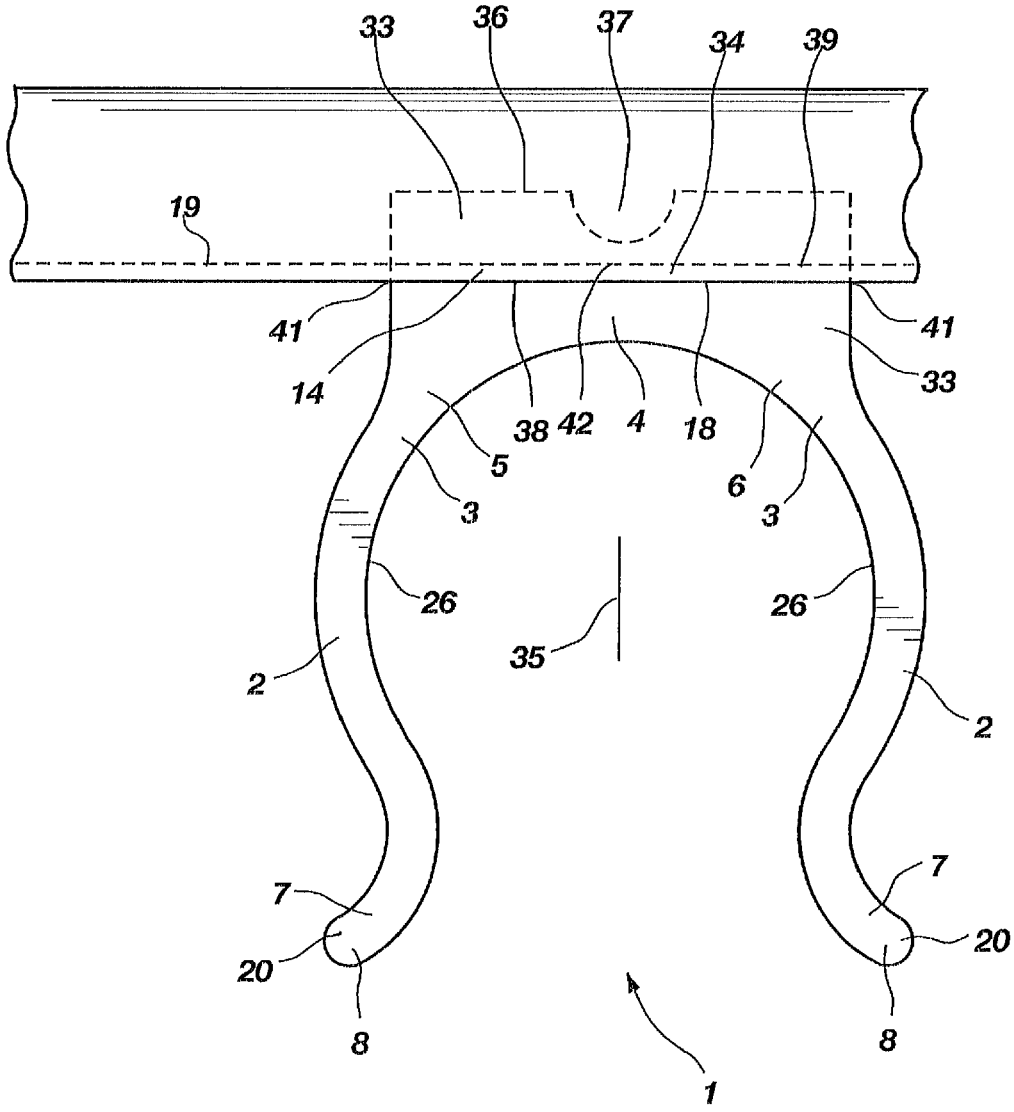
FIG. 7 is a plan view of a second preferred embodiment.
Figure 8:
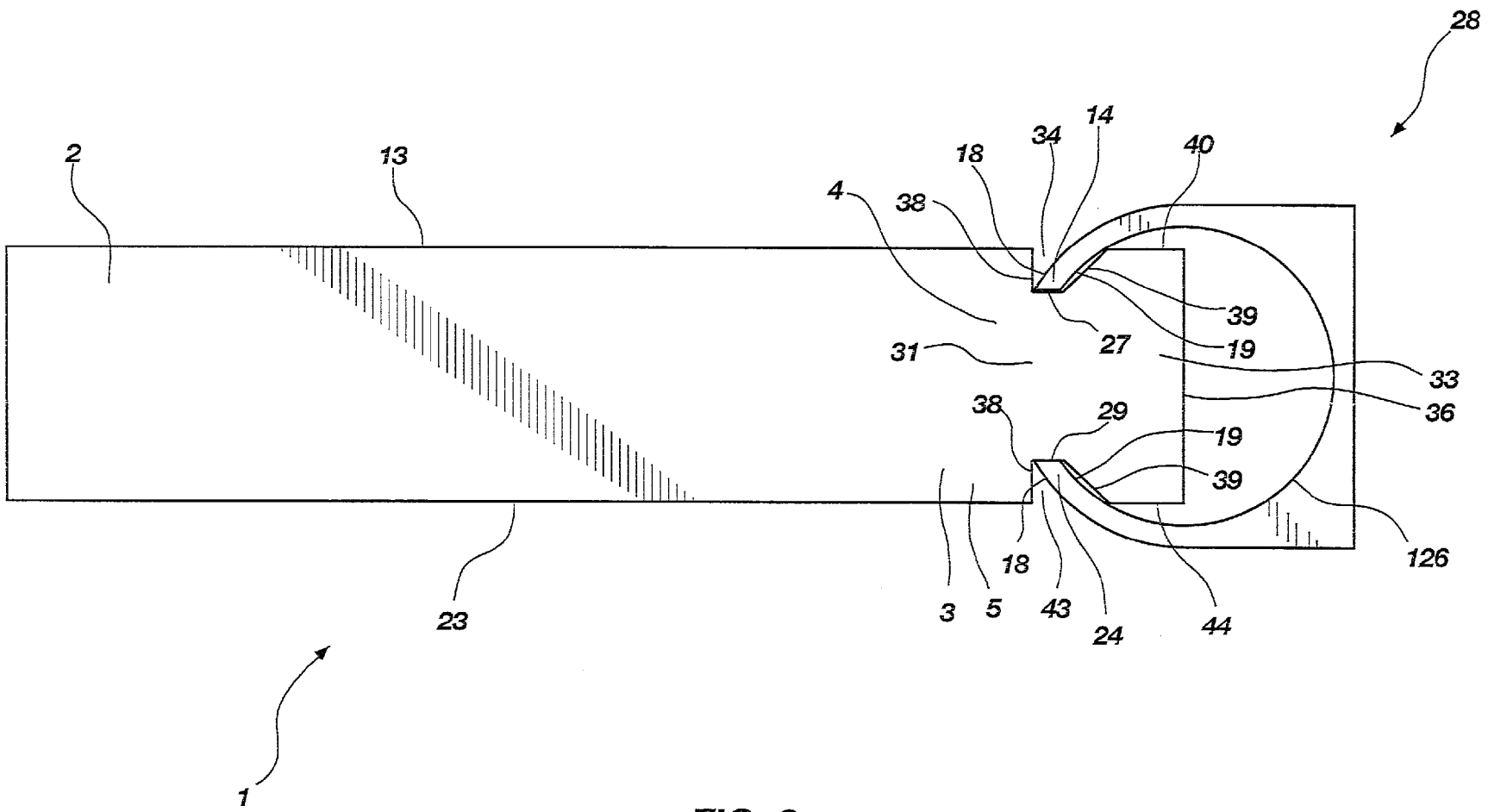
FIG. 8 is a lateral view of a second preferred embodiment.

As illustrated in FIG. 7 and FIG. 8, the second preferred embodiment of the Storage Rack of the present invention has a clamp 1 comprising two or more resilient arms 2, each arm 2 having a first end 3 with such first end 3 attached to a rear section 4, just as does the clamp 1 of the first preferred embodiment. The only differences between the clamp 1 of the second preferred embodiment and the clamp 1 of the first preferred embodiment are that the clamp 1 of the second preferred embodiment has a deformable extension 33 projecting rearwardly from the back 31 of the rear section 4 and contains no apertures but, rather, has at least one channel 34 in the deformable extension 33 with such channel 34 being oriented substantially perpendicular to the plane of symmetry 35 of the clamp 1. (Since the second preferred embodiment contains no apertures, the definition of "rear section 4" for the second preferred embodiment is that portion of the clamp 1, excluding the deformable extension 33, that would be between the first aperture 9 and the second aperture 10 were the clamp 1 a clamp 1 of the first preferred embodiment.)

At the rear 36 of the deformable extension 33 is an indentation 37.

The channel 34 has a forward wall 38 and a rear wall 39. Preferably, but not necessarily, the channel 34 touches, preferably near the point of maximum width for the channel 34, the top 40 of the deformable extension 33 so that a first rail 14 can extend into the channel 34; otherwise, the first rail 14 would run through the channel 34 with such channel 34 being completely within the deformable extension 33.

The dimensions of the channel 34 and of the first rail 14 are preferably selected such that the forward wall 38 of the channel 34 touches a first side 18 of the first rail 14 and the rear wall 39 of the channel 34 touches a second side 19 of the first rail 14 so that the frictional force created by such touching will prevent an empty clamp 1 from sliding along the first rail 14, no matter what the orientation of the first rail 14 may be. (The level of this frictional resistance is, though, as stated above, set, by so selecting the dimensions of the channel 34 and the first rail 14, at a level which can be overcome by a user to slide a clamp 1 to another location on the first rail 14.) The first side 18 and the second side 19 of the first rail 14 are located with respect to each other so that the force created by the forward wall 38 of the channel 34 on the first rail 14 has at least a component that is opposite to at least a component of the force created by the rear wall 39 of the channel 34 on the first rail 14. The first side 18 and the second side 19 are substantially parallel to one another. (If the first rail 14 has a cross section that is shaped other than as a rectangle, "side" refers only to the portion of the first rail 14 against which the necessary force is applied. And if the cross-sectional shape of the channel 34 is other than rectangular, "forward wall" refers to the portion of the deformable extension 33 which generates a force having a component acting generally away from the free ends 8 of the resilient arms 2 while "rear wall" refers to the portion of the deformable extension 33 which generates a force having a component acting generally toward the free ends 8 of the resilient arms 2.)

When a resilient arm 2 attached to an end 5 of the rear section 4 and associated with a deformable extension 33 having the forward wall 38 and the rear wall 39 so formed and the dimensions of the channel 34 and of the first rail 14 so selected, is forced away from a resilient arm 2 attached to the opposite end 6 of the rear section 4, for example, by an object being inserted between such resilient arms 2, the deformable extension 33 and the channel 34 will, especially because of the existence of the indentation 37, tend to deform, increasing the force exerted by the outer edges 41 of the forward wall 38 on the first side 18 of the first rail 14 and drawing the central portion 42 of the rear wall 39 toward the resilient arm 2, thereby enhancing the force exerted by the rear wall 39 on the second side 19 of the first rail 14. The frictional force exerted on the first rail 14 will then be adequate to retain the clamp 1 holding the object in place no matter what the orientation of the first rail 14 may be. Moreover, when a clamp 1 is horizontally oriented, the weight of the object acting on the resilient arm 2 will tend to increase the force exerted by the lower, outer edges 41 of the forward wall 38 the farther such force is applied toward the front 20 of the clamp 1 and will also tend to increase the force exerted by the upper, central portion 42 of the rear wall 39 the farther such force is applied toward the front 20 of the clamp 1.

For the purposes of this patent application, deformability simply means that when an object is inserted between the resilient arms 2, the outer edges 41 of the forward wall 38 and the central portion 42 of the rear wall 39 will increase the forces exerted on the rail 14, as described above.

Additionally, preferably, but not necessarily, the channel 34 has a substantially rectangular cross section. This is also true for the first rail 14, although, as suggested above, the cross section of the channel 34 and the cross section of the first rail 14 can be of any shape and the shape of the channel 34 may even differ from the shape of the cross section of the first rail 14 as long as forces between the walls 38, 39 of the channel 34 and the first rail 14 are as described above.

And even more preferably, but not necessarily, the deformable extension 33 contains a second channel 43 which preferably touches, preferably near the point of maximum width for the second channel 43, the bottom 44 of the deformable extension 33 while the first channel 34 preferably touches, preferably near the point of maximum width for the first channel 34, the top 40 of the deformable extension 33. Also preferably, the shape, dimensions, orientation, and location for the second channel 43 along the bottom 44 of the deformable extension 33 is substantially the same as that for the first channel 34 along the top 40 of the deformable extension 33. A second rail 24 runs through the second channel 43, is substantially parallel to the first rail 14, and is constructed substantially the same as the first rail 14. Consequently, this embodiment has the ability to have the clamp 1 inserted into the rails 14, 24 with either channel 34, 43 associated with either rail 14 or 24.

Just as was the case with respect to the first preferred embodiment, the first rail 14 is, as illustrated in FIG. 8, preferably, but not necessarily, a first radial end 27 of a C-shaped channel 28; and the second rail 24 is preferably, but not necessarily, a second radial end 29 of the C-shaped channel 28.

The C-shaped channel 28 can be attached to a surface by any means that is well known in the art. This would include, but not be limited to, screws.

When the C-shaped channel 28 is utilized, adequate distance must be maintained for the deformable extension 33 to pass any fastener 30. Of course, if a fastener 30—such as a strap tie—that does not intrude into the C-shaped channel 28 is utilized, such clearance is not a concern.

Also, as illustrated in FIG. 8, when the C-shaped channel 28 is employed, the rear wall 39 of the first channel 34 preferably, but not necessarily, curves to the rear as it rises in order to accommodate the shape of the C-shaped channel 28; and the rear wall 39 of the second channel 43 curves to the rear as it descends in order to accommodate the shape of the C-shaped channel 28. Although such curving preferably follows the shape of the C-shaped channel 28, for the purpose of this patent application curve simply means so moving to the rear as the rear wall 39 of the first channel 34 rises or as the rear wall 39 of the second channel 43 descends such rear wall 39 do not physically conflict with the C-shaped channel 28 except as desired to create the frictional force described above. Thus, "curve" comprises even an upwardly or downwardly sloped straight line.

Two optional embodiments, furthermore, exist for the second preferred embodiment.

In both of these embodiments, at least one channel 34, 43 moves toward the rear 36 of the deformable extension 33 as such channel 34, 43 moves from the longitudinal center 45 of the deformable extension 33 toward either a left side 46 or a right side 47 of the deformable extension 33; and, preferably, such channel 34, 43 moves toward the rear 36 of the deformable extension 33 as such channel 34, 43 moves from the longitudinal center 45 of the deformable extension 33 toward the left side 46 of the deformable extension 33 and also as such channel 34, 43 moves from the longitudinal center 45 of the deformable extension 33 toward the right side 47 of the deformable extension 33.

Figure 9:
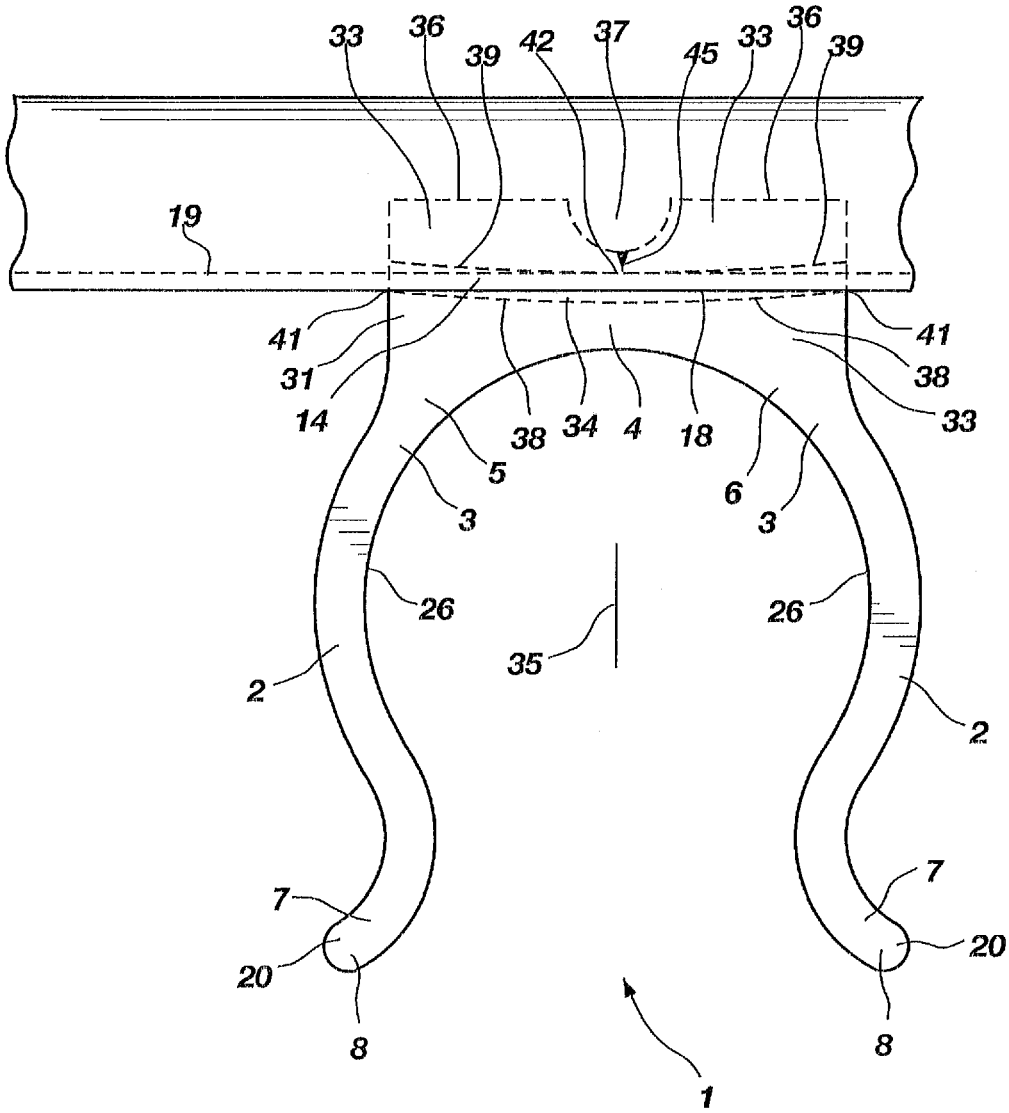
FIG. 9 is a plan view of a first optional version of the second preferred embodiment.
Figure 10:
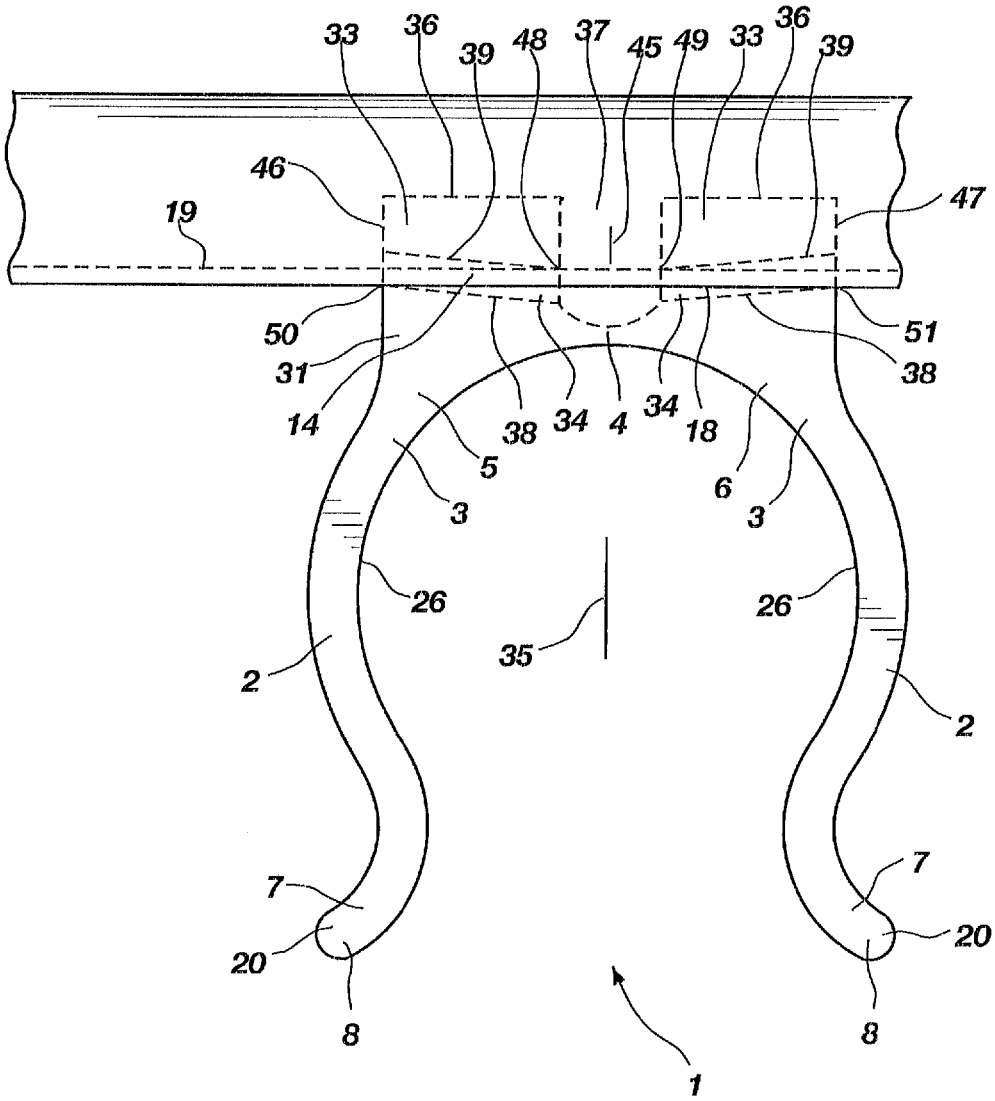
FIG. 10 is a plan view of a second optional version of the second preferred embodiment.

The difference between these two optional versions of the preferred second embodiment is that in the first optional version of the second preferred embodiment, as shown in FIG. 9, the indentation 37 does not enter either channel 34, 43 while in the second optional version of the second preferred embodiment the indentation 37 extends forward at least past the rear wall 39 of the first channel 34 or the rear wall of the second channel 43 or, preferably, as illustrated in FIG. 10, past the rear walls 39 of both channels 34, 43.

With respect to the basic version of the second preferred embodiment, it is immaterial whether the indentation 37 extends into either channel 34, 43 or not. Thus, the optional versions of the second preferred embodiment differ from the basic version of the second preferred embodiment only in having at least one channel 34, 43 angled as described above.

For the first optional version of the second preferred embodiment, at least one outer edge 41 of the forward wall 38 of at least one channel 34, 43 touches a first side 18 of the rail 14, 24 running through such channel 34, 43 and the central portion 42 of the rear wall 39 of any such channel 34, 43 touches a second side 19 of the rail 14, 24 running through such channel 34, 43. (The level of frictional resistance produced by such touching is, though, as stated above, set, by so selecting the dimensions of the channel 34, 43 and the rail 14, 24 running through such channel 34, 43 at a level which can be overcome by a user to slide a clamp 1 to another location on the first rail 14. Furthermore, such resistance can be reduced by pushing the resilient arms 2 toward one another.)

For the second optional version of the second preferred embodiment, the intrusion of the indentation 37 through the rear wall 39 of one or both channels 34, 43 creates a left inner edge 48 of the rear wall 39 and a right inner edge 49 of the rear wall 39. For convenience, the outer edge 41 of the forward wall 38 closer to the left inner edge 48 is designated the left outer edge 50; and the outer edge 41 of the forward wall 38 closer to the right inner edge 49 is designated the right outer edge 51. Furthermore, for a given channel 34, 43, the left inner edge 48 is termed "the associated inner edge" of the left outer edge 50, the left outer edge 50 is termed "the associated outer edge" of the left inner edge 48, the right inner edge 49 is termed "the associated inner edge" of the right outer edge 51, and the right outer edge 51 is termed "the associated outer edge" of the right inner edge 49.

Preferably, for at least one channel 34, 43 either (a) a left outer edge 50 touches a first side 18 of the rail 14, 24 running through such channel 34, 43 and a left inner edge 48 touches a second side 19 of the rail 14, 24 running through such channel 34, 43 or (b) a right outer edge 51 touches a first side 18 of the rail 14, 24 running through such channel 34, 43 and a right inner edge 49 touches a second side 19 of the rail 14, 24 running through such channel 34, 43 or (c) both outer edges 50, 51 touch a first side 18 of the rail 14, 24 running through such channel 34, 43 and both inner edges 48, 49 touch a second side 19 of the rail 14, 24 running through such channel 34, 43.

Again, the level of frictional resistance produced by such touching is, though, as stated above, set, by so selecting the dimensions of the channel 34, 43 and the rail 14, 24 running through such channel 34, 43 at a level which can be overcome by a user to slide a clamp 1 to another location on the first rail 14. Furthermore, such resistance can be reduced by pushing the resilient arms 2 toward one another.

As used herein the term "preferable" or "preferably" means that a specified element or technique is more acceptable than another but not that such specified element or technique is a necessity.

We claim:

1. A storage rack, which comprises:

a first rail having at least a first side and a second side;

a second rail having at least a first side and a second side, said second rail being substantially parallel to said first rail; and a clamp, said clamp comprising:

a rear section having a first end and a second end with the first end and the second end being substantially opposite one another;

a first resilient arm having a first end attached to the first end of said rear section and also having a top, bottom, an inner lateral surface, an outer lateral surface, a free end, and an aperture, designated the first aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the first aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface; and a second resilient arm having a first end attached to the second end of said rear section and also having a top, bottom, an inner lateral surface, an outer lateral surface, a free end, and an aperture, designated the second aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the second aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, wherein, as the distance along said resilient arms from said rear section is increased, the distance between said rear arms is greater until, at even greater distances from said rear section along said resilient arms, the distance between said resilient arms is progressively less while still having the free ends remaining sufficiently distant from each other to permit the introduction of an object that is desired to be held between said resilient arms, wherein:

said first rail runs through the aperture in said first resilient arm and the aperture in said second resilient;

said first resilient arm has an additional aperture, designated the third aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the third aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface;

said second resilient arm has an additional aperture, designated the fourth aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the fourth aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, with said second rail running through the third and fourth apertures;

for at least one resilient arm, the forward wall of one or more of the apertures and the rear wall of such one or more of the apertures in that resilient arm are formed so that the outer edge of the forward wall touches the first side of said first rail while the inner edge of the rear wall of that aperture touches the second side of said first rail;

after having the distance between said resilient arms decrease with increasing distance from said rear section, as the distance along said resilient arms from said rear section is further increased, the distance between said resilient arms is progressively decreased;

each resilient arm is constructed so that each aperture has a substantially rectangular cross section;

the first aperture touches the top of said first resilient arm, and the third aperture touches the bottom of said first resilient arm;

the second aperture touches the top of said first resilient arm, and the fourth aperture touches the bottom of said first resilient arm;

said first rail is a first radial end of a C-shaped channel;

said second rail is a second radial end of a C-shaped channel;

said first resilient arm is constructed so that the rear wall of the first aperture curves to the rear as the rear wall of the first aperture rises, to accommodate the shape of the C-shaped channel and so that the rear wall of the third aperture curves to the rear as the rear wall of the third aperture descends, to accommodate the shape of the C-shaped channel; and said second resilient arm is constructed so that the rear wall of the second aperture curves to the rear as the rear wall of the second aperture rises, to accommodate the shape of the C-shaped channel and so that the rear wall of the fourth aperture curves to the rear as the rear wall of the fourth aperture descends, in order to accommodate the shape of the C-shaped channel.

2. A storage rack, which comprises:

a first rail having at least a first side and a second side;

a second rail having at least a first side and a second side, said second rail being substantially parallel to said first rail; and a clamp, said clamp comprising:

a rear section having a first end and a second end with the first end and the second end being substantially opposite one another;

a first resilient arm having a first end attached to the first end of said rear section and also having a top, bottom, an inner lateral surface, an outer lateral surface, a free end, and an aperture, designated the first aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the first aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface; and a second resilient arm having a first end attached to the second end of said rear section and also having a top, bottom, an inner lateral surface, an outer lateral surface, a free end, and an aperture, designated the second aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the second aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, wherein, as the distance along said resilient arms from said rear section is increased, the distance between said rear arms is greater until, at even greater distances from said rear section along said resilient arms, the distance between said resilient arms is progressively less while still having the free ends remaining sufficiently distant from each other to permit the introduction of an object that is desired to be held between said resilient arms, wherein:

said first rail runs through the aperture in said first resilient arm and the aperture in said second resilient;

said first resilient arm has an additional aperture, designated the third aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the third aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface;

said second resilient arm has an additional aperture, designated the fourth aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the fourth aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, with said second rail running through the third and fourth apertures;

after having the distance between said resilient arms decrease with increasing distance from said rear section, as the distance along said resilient arms from said rear section is further increased, the distance between said resilient arms is progressively decreased;

each resilient arm is constructed so that each aperture has a substantially rectangular cross section;

the first aperture touches the top of said first resilient arm, and the third aperture touches the bottom of said first resilient arm;

the second aperture touches the top of said first resilient arm, and the fourth aperture touches the bottom of said first resilient arm;

said first rail is a first radial end of a C-shaped channel;

said second rail is a second radial end of a C-shaped channel;

said first resilient arm is constructed so that the rear wall of the first aperture curves to the rear as the rear wall of the first aperture rises, to accommodate the shape of the C-shaped channel and so that the rear wall of the third aperture curves to the rear as the rear wall of the third aperture descends, to accommodate the shape of the C-shaped channel; and said second resilient arm is constructed so that the rear wall of the second aperture curves to the rear as the rear wall of the second aperture rises, to accommodate the shape of the C-shaped channel and so that the rear wall of the fourth aperture curves to the rear as the rear wall of the fourth aperture descends, to accommodate the shape of the C-shaped channel.

3. A storage rack, which comprises:

a first rail having at least a first side and a second side;

a second rail having at least a first side and a second side, said second rail being substantially parallel to said first rail; and a clamp, said clamp comprising:

a rear section having a first end and a second end with the first end and the second end being substantially opposite one another;

a first resilient arm having a first end attached to the first end of said rear section and also having a top, bottom, an inner lateral surface, an outer lateral surface, a free end, and an aperture, designated the first aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the first aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface; and a second resilient arm having a first end attached to the second end of said rear section and also having a top, bottom, an inner lateral surface, an outer lateral surface, a free end, and an aperture, designated the second aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the second aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, wherein, as the distance along said resilient arms from said rear section is increased, the distance between said rear arms is greater until, at even greater distances from said rear section along said resilient arms, the distance between said resilient arms is progressively less while still having the free ends remaining sufficiently distant from each other to permit the introduction of an object that is desired to be held between said resilient arms, wherein:

said first rail runs through the aperture in said first resilient arm and the aperture in said second resilient;

said first resilient arm has an additional aperture, designated the third aperture, possessing a forward wall, said forward wall comprising a portion of said first resilient arm extending from the inner lateral surface to the outer lateral surface, and a rear wall, said rear wall comprising a portion of the rear section extending from the inner lateral surface to the outer lateral surface, with each wall of the third aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface;

said second resilient arm has an additional aperture, designated the fourth aperture, possessing a forward wall, said forward wall comprising a portion of said second resilient arm extending from the inner lateral surface to the outer lateral surface, and a rear wall, said rear wall comprising a portion of the rear section extending from the inner lateral surface to the outer lateral surface, with each wall of the fourth aperture having an inner edge and an outer edge, the inner edge of the forward wall comprising the intersection of the forward wall with the inner lateral surface, the outer edge of the forward wall comprising the intersection of the forward wall with the outer lateral surface, the inner edge of the rear wall comprising intersection of the rear wall with the inner lateral surface, and the outer edge of the rear wall comprising intersection of the rear wall with the outer lateral surface, with said second rail running through the third and fourth apertures;

after having the distance between said resilient arms decrease with increasing distance from said rear section, as the distance along said resilient arms from said rear section is further increased, the distance between said resilient arms is progressively decreased;

the first aperture touches the top of said first resilient arm, and the third aperture touches the bottom of said first resilient arm;

the second aperture touches the top of said first resilient arm, and the fourth aperture touches the bottom of said first resilient arm;

said first rail is a first radial end of a C-shaped channel;

said second rail is a second radial end of a C-shaped channel;

said first resilient arm is constructed so that the rear wall of the first aperture curves to the rear as the rear wall of the first aperture rises, to accommodate the shape of the C-shaped channel and so that the rear wall of the third aperture curves to the rear as the rear wall of the third aperture descends, to accommodate the shape of the C-shaped channel; and said second resilient arm is constructed so that the rear wall of the second aperture curves to the rear as the rear wall of the second aperture rises, to accommodate the shape of the C-shaped channel and so that the rear wall of the fourth aperture curves to the rear as the rear wall of the fourth aperture descends, to accommodate the shape of the C-shaped channel.

* * * * *